US012514288B2

(12) United States Patent
Aller et al.

(10) Patent No.: US 12,514,288 B2
(45) **Date of Patent: *Jan. 6, 2026**

(54) CUSTOMIZABLE PANEL FOR AEROSOL DELIVERY DEVICE

(71) Applicant: RAI Strategic Holdings, Inc., Winston-Salem, NC (US)

(72) Inventors: Jared Aller, Winston-Salem, NC (US); Bill Webb, San Francisco, CA (US); Chris Harsacky, San Francisco, CA (US)

(73) Assignee: RAI STRATEGIC HOLDINGS, INC., Winston-Salem, NC (US)

( * ) Notice: Subject to any disclaimer, the term of this patent is extended or adjusted under 35 U.S.C. 154(b) by 147 days.

This patent is subject to a terminal disclaimer.

(21) Appl. No.: 18/514,895

(22) Filed: Nov. 20, 2023

(65) Prior Publication Data

US 2024/0081400 A1 Mar. 14, 2024

Related U.S. Application Data

(63) Continuation of application No. 17/073,930, filed on Oct. 19, 2020, now Pat. No. 11,856,986.

(51) Int. Cl.

| | |
|---|---|
| ***A24F 40/40*** | (2020.01) |
| ***A24F 40/50*** | (2020.01) |
| ***A24F 40/60*** | (2020.01) |

(52) U.S. Cl.

CPC ..... *A24F 40/40* (2020.01); *A24F 40/50* (2020.01); *A24F 40/60* (2020.01)

(58) Field of Classification Search

CPC ..... A24F 40/40; A24F 40/42; A24F 40/50; A24F 40/60

See application file for complete search history.

(56) References Cited

U.S. PATENT DOCUMENTS

| | | | |
|---|---|---|---|
| 2,057,353 | A | 10/1936 | Whittemore, Jr. |
| 2,104,266 | A | 1/1938 | McCormick |

(Continued)

FOREIGN PATENT DOCUMENTS

| | | |
|---|---|---|
| CN | 1541577 | 11/2004 |
| CN | 2719043 | 8/2005 |

(Continued)

OTHER PUBLICATIONS

International Search Report from corresponding International App. No. PCT/IB2021/059582, mailed Jan. 20, 2022.

*Primary Examiner* — Hae Moon Hyeon

(74) *Attorney, Agent, or Firm* — Womble Bond Dickinson (US) LLP

(57) ABSTRACT

The present disclosure provides an aerosol delivery device and a control unit for use in an aerosol delivery device configured to receive a removable and replaceable aerosol precursor consumable. The control unit comprises a body frame having a proximal end and a distal end, the proximal end of the body frame defining a first portion of a receiving chamber, and a removable and replaceable housing panel configured to be releasably received onto the body frame. In one implementation, the housing panel forms part of an outer surface of the control unit, and the housing panel forms a second portion of the receiving chamber. In another implementation, the housing panel forms part of an outer surface of the control unit, and the body frame includes a rail feature configured to slidably engage a complementary rail feature of the housing panel.

20 Claims, 5 Drawing Sheets

(56) References Cited

U.S. PATENT DOCUMENTS

| | | | | |
|---|---|---|---|---|
| 3,200,819 | A | 8/1965 | Gilbert | |
| 4,922,901 | A | 5/1990 | Brooks et al. | |
| 5,060,671 | A | 10/1991 | Counts et al. | |
| 5,093,894 | A | 3/1992 | Deevi et al. | |
| 5,181,626 | A | 1/1993 | Daenen et al. | |
| 5,894,841 | A | 4/1999 | Voges | |
| 6,125,853 | A | 10/2000 | Susa et al. | |
| 6,155,268 | A | 12/2000 | Takeuchi | |
| 7,117,867 | B2 | 10/2006 | Cox et al. | |
| 7,832,410 | B2 | 11/2010 | Hon | |
| 8,314,591 | B2 | 11/2012 | Terry et al. | |
| 8,365,742 | B2 | 2/2013 | Hon | |
| 8,499,766 | B1 | 8/2013 | Newton | |
| 8,528,569 | B1 | 9/2013 | Newton | |
| 8,833,364 | B2 | 9/2014 | Buchberger | |
| 9,220,304 | B2 | 12/2015 | Greim | |
| 9,462,831 | B2 | 10/2016 | Liu | |
| 9,877,508 | B2 | 1/2018 | Kane | |
| 10,015,990 | B2 | 7/2018 | Mironov | |
| 10,028,537 | B1 | 7/2018 | Hawes et al. | |
| 10,058,125 | B2 | 8/2018 | Worm et al. | |
| 10,080,851 | B2 | 9/2018 | Davidson et al. | |
| 10,085,481 | B2 | 10/2018 | Verleur et al. | |
| 10,092,037 | B2 | 10/2018 | Tucker et al. | |
| 10,104,913 | B2 | 10/2018 | Lau et al. | |
| 10,117,463 | B2 | 11/2018 | Thomas | |
| 10,117,467 | B2 | 11/2018 | Hawes et al. | |
| 10,314,341 | B2 | 6/2019 | Shin | |
| 11,612,186 | B2 | 3/2023 | Watanabe et al. | |
| 11,856,986 | B2 * | 1/2024 | Aller | A24F 40/40 |
| 12,115,306 | B2 * | 10/2024 | Ricketts | A61M 11/042 |
| 2005/0016550 | A1 | 1/2005 | Katase | |
| 2006/0196518 | A1 | 9/2006 | Hon | |
| 2008/0092912 | A1 | 4/2008 | Robinson et al. | |
| 2009/0095311 | A1 | 4/2009 | Hon | |
| 2009/0126745 | A1 | 5/2009 | Hon | |
| 2009/0151717 | A1 | 6/2009 | Bowen et al. | |
| 2009/0188490 | A1 | 7/2009 | Hon | |
| 2009/0272379 | A1 | 11/2009 | Thorens et al. | |
| 2009/0320863 | A1 | 12/2009 | Fernando et al. | |
| 2011/0094523 | A1 | 4/2011 | Thorens et al. | |
| 2011/0126848 | A1 | 6/2011 | Zuber et al. | |
| 2011/0155718 | A1 | 6/2011 | Greim et al. | |
| 2011/0168194 | A1 | 7/2011 | Hon | |
| 2011/0265806 | A1 | 11/2011 | Alarcon et al. | |
| 2013/0037041 | A1 | 2/2013 | Worm et al. | |
| 2013/0042865 | A1 | 2/2013 | Monsees et al. | |
| 2013/0306084 | A1 | 11/2013 | Flick | |
| 2013/0319435 | A1 | 12/2013 | Flick | |
| 2014/0000638 | A1 | 1/2014 | Sebastian et al. | |
| 2014/0096781 | A1 | 4/2014 | Sears et al. | |
| 2014/0096782 | A1 | 4/2014 | Ampolini et al. | |
| 2014/0253144 | A1 | 9/2014 | Novak et al. | |
| 2014/0261408 | A1 | 9/2014 | DePiano et al. | |
| 2014/0261486 | A1 | 9/2014 | Potter et al. | |
| 2014/0261487 | A1 | 9/2014 | Chapman et al. | |
| 2014/0366898 | A1 | 12/2014 | Monsees et al. | |
| 2015/0020832 | A1 | 1/2015 | Greim et al. | |
| 2015/0150308 | A1 | 6/2015 | Monsees et al. | |
| 2015/0164142 | A1 | 6/2015 | Li et al. | |
| 2015/0208729 | A1 | 7/2015 | Monsees et al. | |
| 2015/0313287 | A1 | 11/2015 | Verleur et al. | |
| 2016/0270438 | A1 | 9/2016 | Jackson et al. | |
| 2016/0271347 | A1 | 9/2016 | Raichman | |
| 2017/0027226 | A1 | 2/2017 | Mironov et al. | |
| 2017/0071256 | A1 | 3/2017 | Verleur et al. | |
| 2017/0095005 | A1 | 4/2017 | Monsees et al. | |
| 2017/0135404 | A1 | 5/2017 | Reevell | |
| 2017/0135405 | A1 | 5/2017 | Reevell | |
| 2017/0143042 | A1 | 5/2017 | Batista et al. | |
| 2017/0215485 | A1 | 8/2017 | Zitzke | |
| 2017/0231281 | A1 | 8/2017 | Hatton et al. | |
| 2017/0231282 | A1 | 8/2017 | Hatton et al. | |
| 2017/0325289 | A1 | 11/2017 | Liu | |
| 2017/0340011 | A1 | 11/2017 | Batista | |
| 2017/0340012 | A1 | 11/2017 | Mironov et al. | |
| 2017/0347711 | A1 | 12/2017 | Litten et al. | |
| 2017/0347712 | A1 | 12/2017 | Singh | |
| 2018/0000157 | A1 | 1/2018 | Batista et al. | |
| 2018/0000160 | A1 | 1/2018 | Taschner et al. | |
| 2018/0014575 | A1 | 1/2018 | Fursa | |
| 2018/0020731 | A1 | 1/2018 | Rasmussen et al. | |
| 2018/0020736 | A1 | 1/2018 | Silvestrini | |
| 2018/0035717 | A1 | 2/2018 | Batista | |
| 2018/0042306 | A1 | 2/2018 | Atkins et al. | |
| 2018/0043114 | A1 | 2/2018 | Bowen et al. | |
| 2018/0077967 | A1 | 3/2018 | Hatton et al. | |
| 2018/0084831 | A1 | 3/2018 | Mironov | |
| 2018/0103685 | A1 | 4/2018 | Yener | |
| 2018/0132525 | A1 | 5/2018 | Patil et al. | |
| 2018/0140019 | A1 | 5/2018 | Guo et al. | |
| 2018/0168224 | A1 | 6/2018 | Naughton et al. | |
| 2018/0177230 | A1 | 6/2018 | Hawes et al. | |
| 2018/0213850 | A1 | 8/2018 | Brinkley et al. | |
| 2018/0242643 | A1 | 8/2018 | Silvestrini et al. | |
| 2018/0280637 | A1 | 10/2018 | Mayle et al. | |
| 2018/0295888 | A1 | 10/2018 | Newcomb et al. | |
| 2018/0296777 | A1 | 10/2018 | Terry et al. | |
| 2019/0166913 | A1 | 6/2019 | Trzecieski | |
| 2020/0187560 | A1 * | 6/2020 | Trzecieski | A24F 40/44 |
| 2020/0345960 | A1 | 11/2020 | Begin et al. | |
| 2021/0022399 | A1 * | 1/2021 | Clough | A24F 40/42 |
| 2021/0307388 | A1 * | 10/2021 | Griffin | A24F 7/02 |
| 2022/0117299 | A1 * | 4/2022 | Aller | A24F 40/60 |
| 2023/0000156 | A1 | 1/2023 | Griffin et al. | |
| 2023/0088850 | A1 | 3/2023 | Blackmon et al. | |
| 2023/0094447 | A1 | 3/2023 | Gawdiak-Smyth et al. | |
| 2023/0225401 | A1 * | 7/2023 | Lau | A24F 40/42 131/69 |

FOREIGN PATENT DOCUMENTS

| | | | |
|---|---|---|---|
| CN | 201379072 | | 1/2010 |
| CN | 204232280 | | 4/2015 |
| CN | 106617324 | | 5/2017 |
| CN | 106723381 | | 5/2017 |
| CN | 206482013 | | 9/2017 |
| EP | 1 618 803 | | 1/2006 |
| EP | 2 779 851 | | 10/2016 |
| EP | 3 711 571 | | 9/2020 |
| GB | 2534213 | | 7/2016 |
| JP | 2018508308 | A | 3/2018 |
| JP | 20190513349 | A | 5/2019 |
| JP | 2021520188 | A | 8/2021 |
| KR | 20160116991 | | 10/2016 |
| KR | 20180001840 | A | 1/2018 |
| WO | WO 2004/080216 | | 9/2004 |
| WO | WO 2005/099494 | | 10/2005 |
| WO | WO 2007/131449 | | 11/2007 |
| WO | WO 2014/020953 | | 2/2014 |
| WO | WO 2016/026811 | | 2/2016 |
| WO | WO 2016/207407 | | 12/2016 |
| WO | WO 2017/051006 | | 3/2017 |
| WO | WO 2016/207442 | | 5/2017 |
| WO | WO 2017/102969 | | 6/2017 |
| WO | 2017167932 | A1 | 10/2017 |
| WO | WO 2017/194763 | | 11/2017 |
| WO | WO 2018/167166 | | 9/2018 |
| WO | WO 2018/202732 | | 11/2018 |
| WO | WO 2019/084161 | | 5/2019 |
| WO | 2019206942 | A1 | 10/2019 |
| WO | WO 2019/202048 | | 10/2019 |
| WO | WO 2020/079226 | | 4/2020 |

* cited by examiner

CUSTOMIZABLE PANEL FOR AEROSOL DELIVERY DEVICE

CROSS-REFERENCE TO RELATED APPLICATIONS

This application is a continuation of U.S. patent application Ser. No. 17/073,930, filed on Oct. 19, 2020, titled Customizable Panel for Aerosol Delivery Device, which is incorporated herein in its entirety by reference.

FIELD OF THE DISCLOSURE

The present disclosure relates to aerosol delivery devices such as smoking articles, and more particularly to aerosol delivery devices that utilize electrically generated energy and/or combustible carbon-based ignition sources for the production of aerosol (e.g., smoking articles commonly referred to heat-not-burn systems or electronic cigarettes). The smoking articles may be configured to heat an aerosol precursor, which may incorporate materials that may be made or derived from tobacco or otherwise incorporate tobacco, the precursor being capable of forming an inhalable substance for human consumption.

BACKGROUND

Many smoking articles have been proposed through the years as improvements upon, or alternatives to, smoking products based upon combusting tobacco. Example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference in its entirety.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0220232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon, which are incorporated herein by reference.

Various manners and methods for assembling smoking articles that possess a plurality of sequentially arranged segmented components have been proposed. See, for example, the various types of assembly techniques and methodologies set forth in U.S. Pat. No. 5,469,871 to Barnes et al. and U.S. Pat. No. 7,647,932 to Crooks et al.; and U.S. Pat. App. Pub. Nos. 2010/0186757 to Crooks et al.; 2012/0042885 to Stone et al., and 2012/00673620 to Conner et al.; each of which is incorporated by reference herein in its entirety.

Certain types of cigarettes that employ carbonaceous fuel elements have been commercially marketed under the brand names "Premier," "Eclipse" and "Revo" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Additionally, a similar type of cigarette has been marketed in Japan by Japan Tobacco Inc. under the brand name "Steam Hot One."

In some instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

As such, it would be desirable to provide smoking articles that address one or more of the technical problems sometimes associated with traditional types of smoking articles. In addition, it would be desirable to provide a smoking article that is easy to use and that provides reusable and/or replaceable components.

BRIEF SUMMARY

The present disclosure relates to aerosol delivery devices and control units for use with aerosol delivery devices. The present disclosure includes, without limitation, the following example implementations:

Example Implementation 1: A control unit for use in an aerosol delivery device configured to receive a removable and replaceable aerosol precursor consumable, the control unit comprising a body frame having a proximal end and a distal end, the proximal end of the body frame defining a first portion of a receiving chamber, and a removable and replaceable housing panel configured to be releasably received onto the body frame, wherein the housing panel forms part of an outer surface of the control unit, and wherein the housing panel forms a second portion of the receiving chamber.

Example Implementation 2: The control unit of Example Implementation 1, or any combination of preceding example implementations, wherein the housing panel forms a single outer surface of the control unit.

Example Implementation 3: The control unit of any of Example Implementations 1-2, or any combination of preceding example implementations, wherein the housing panel forms two or more outer surfaces of the control unit.

Example Implementation 4: The control unit of any of Example Implementations 1-3, or any combination of preceding example implementations, wherein the housing panel includes a rail feature, and wherein the body frame includes a complementary rail feature configured to slidably engage with the rail feature of the housing panel.

Example Implementation 5: The control unit of any of Example Implementations 1-4, or any combination of preceding example implementations, wherein the housing panel includes a customizable feature comprising one or more of a surface color of the housing panel, a surface contour of the housing panel, a surface pattern of the housing panel, a surface texture of the housing panel, one or more surface projections of the housing panel, a profile of the housing panel, a material of the housing panel, or any combination thereof.

Example Implementation 6: The control unit of any of Example Implementations 1-5, or any combination of preceding example implementations, further comprising an output element configured to provide a visually perceptible output signal, and wherein the housing panel includes an output feature configured to allow the output signal to pass therethrough.

Example Implementation 7: The control unit of any of Example Implementation 1-6, or any combination of preceding example implementations, wherein the output feature of the housing panel comprises one or more of an aperture that extends through the housing panel, a series of microperforations that extend through the housing panel, a light tube configured to transmit the output signal through the housing panel, or any combination thereof.

Example Implementation 8: The control unit of any of Example Implementation 1-7, or any combination of preceding example implementations, further comprising an input element configured to receive an input signal from a user, and wherein the housing panel includes an input feature configured to allow the input signal to pass therethrough.

Example Implementation 9: The control unit of any of Example Implementations 1-8, or any combination of preceding example implementations, wherein the input element comprises a button, and wherein the input feature of the housing panel comprises an aperture that extends through the housing panel.

Example Implementation 10: The control unit of any of Example Implementations 1-9, or any combination of preceding example implementations, wherein the input element comprises a button, and wherein the input feature of the housing panel comprises a corresponding button of the housing panel.

Example Implementation 11: The control unit of any of Example Implementations 1-10, or any combination of preceding example implementations, wherein one or both of the body frame or the housing panel includes a securing feature configured to releasably secure the housing panel to the body frame.

Example Implementation 12: The control unit of any of Example Implementations 1-11, or any combination of preceding example implementations, wherein the securing feature comprises one or more of a magnetic securing feature, a detent securing feature, a spring-loaded securing feature, or any combination thereof.

Example Implementation 13: The control unit of any of Example Implementations 1-12, or any combination of preceding example implementations, wherein the securing feature comprises a friction interface between the housing panel and the body frame.

Example Implementation 14: The control unit of any of Example Implementations 1-13, or any combination of preceding example implementations, wherein the body frame includes an electrical connection element proximate a distal end thereof, wherein the housing panel includes an electrical connector proximate a distal end thereof, and wherein the electrical connector of the housing panel is configured to couple with the electrical connection element of the body frame.

Example Implementation 15: The control unit of any of Example Implementations 1-14, or any combination of preceding example implementations, wherein the housing panel includes a power source configured to provide power to the control unit via the electrical connector and electrical connection element.

Example Implementation 16: A control unit for use in an aerosol delivery device configured to receive a removable and replaceable aerosol precursor consumable, the control unit comprising a body frame having a proximal end and a distal end, the proximal end of the body frame defining at least a portion of a receiving chamber, and a removable and replaceable housing panel configured to be releasably received onto the body frame, the housing panel including a rail feature, wherein the housing panel forms part of an outer surface of the control unit, and wherein the body frame includes a rail feature configured to slidably engage with the rail feature of the housing panel.

Example Implementation 17: The control unit of Example Implementation 16, or any combination of preceding example implementations, wherein the housing panel forms a single outer surface of the aerosol delivery device.

Example Implementation 18: The control unit of any of Example Implementations 16-17, or any combination of preceding example implementations, wherein the housing panel forms two or more outer surfaces of the aerosol delivery device.

Example Implementation 19: The control unit of any of Example Implementations 16-18, or any combination of preceding example implementations, wherein the body frame defines a first portion of the receiving chamber, and wherein the housing panel forms a second portion of the receiving chamber.

Example Implementation 20: The control unit of any of Example Implementations 16-19, or any combination of preceding example implementations, wherein the housing panel includes a customizable feature comprising one or more of a surface color of the housing panel, a surface contour of the housing panel, a surface pattern of the housing panel, a surface texture of the housing panel, one or more surface projections of the housing panel, a profile of the housing panel, a material of the housing panel, or any combination thereof.

Example Implementation 21: The control unit of any of Example Implementations 16-20, or any combination of preceding example implementations, further comprising an output element configured to provide a visually perceptible output signal, and wherein the housing panel includes an output feature configured to allow the output signal to pass therethrough.

Example Implementation 22: The control unit of any of Example Implementations 16-21, or any combination of preceding example implementations, wherein the output feature of the housing panel comprises one or more of an aperture that extends through the housing panel, a series of microperforations that extend through the housing panel, a light tube configured to transmit the output signal through the housing panel, or any combination thereof.

Example Implementation 23: The control unit of any of Example Implementations 16-22, or any combination of preceding example implementations, further comprising an input element configured to receive an input signal from a user, and wherein the housing panel includes an input feature configured to allow the input signal to pass therethrough.

Example Implementation 24: The control unit of any of Example Implementations 16-23, or any combination of preceding example implementations, wherein the input element comprises a button, and wherein the input feature of the housing panel comprises an aperture that extends through the housing panel.

Example Implementation 25: The control unit of any of Example Implementations 16-24, or any combination of preceding example implementations, wherein the input element of the control unit comprises a button, and wherein the input feature of the housing panel comprises or a corresponding button of the housing panel.

Example Implementation 26: The control unit of any of Example Implementations 16-25, or any combination of preceding example implementations, wherein one or both of the body frame or the housing panel includes a securing feature configured to releasably secure the housing panel to the body frame.

Example Implementation 27: The control unit of any of Example Implementations 16-26, or any combination of preceding example implementations, wherein the securing feature comprises one or more of a magnetic securing feature, a detent securing feature, a spring-loaded securing feature, or any combination thereof.

Example Implementation 28: The control unit of any of Example Implementations 16-27, or any combination of preceding example implementations, wherein the securing feature comprises a friction interface between the housing panel and the body frame.

Example Implementation 29: The control unit of any of Example Implementations 16-28, or any combination of preceding example implementations, wherein the body frame includes an electrical connection element proximate a distal end thereof, wherein the housing panel includes an electrical connector proximate a distal end thereof, and wherein the electrical connector of the housing panel is configured to couple with the electrical connection element of the body frame.

Example Implementation 30: The control unit of any of Example Implementations 16-29, or any combination of preceding example implementations, wherein the housing panel includes a power source configured to provide power to the control unit via the electrical connector and electrical connection element.

Example Implementation 31: An aerosol delivery device comprising a control unit that includes a body frame having a proximal end and a distal end, the proximal end of the body frame defining a first portion of a receiving chamber, a removable and replaceable aerosol precursor consumable, at least a portion of the consumable configured to be received into the receiving chamber, and a removable and replaceable housing panel configured to be releasably received onto the body frame of the control unit, wherein the housing panel forms part of an outer surface of the control unit, and wherein the housing panel forms a second portion of the receiving chamber.

Example Implementation 32: The aerosol delivery device of Example Implementation 31, or any combination of preceding example implementations, wherein the housing panel forms a single outer surface of the aerosol delivery device.

Example Implementation 33: The aerosol delivery device of any of Example Implementations 31-32, or any combination of preceding example implementations, wherein the housing panel forms two or more outer surfaces of the aerosol delivery device.

Example Implementation 34: The aerosol delivery device of any of Example Implementations 31-33, or any combination of preceding example implementations, wherein the housing panel includes a rail feature, and wherein the body frame includes a complementary rail feature configured to slidably engage with the rail feature of the housing panel.

Example Implementation 35: The aerosol delivery device of any of Example Implementations 31-34, or any combination of preceding example implementations, wherein the housing panel includes a customizable feature comprising one or more of a surface color of the housing panel, a surface contour of the housing panel, a surface pattern of the housing panel, a surface texture of the housing panel, one or more surface projections of the housing panel, a profile of the housing panel, a material of the housing panel, or any combination thereof.

Example Implementation 36: The aerosol delivery device of any of Example Implementations 31-35, or any combination of preceding example implementations, wherein the control unit includes an output element configured to provide a visually perceptible output signal, and wherein the housing panel includes an output feature configured to allow the output signal to pass therethrough.

Example Implementation 37: The aerosol delivery device of any of Example Implementations 31-36, or any combination of preceding example implementations, wherein the output feature of the housing panel comprises one or more of an aperture that extends through the housing panel, a series of microperforations that extend through the housing panel, a light tube configured to transmit the output signal through the housing panel, or any combination thereof.

Example Implementation 38: The aerosol delivery device of any of Example Implementations 31-37, or any combination of preceding example implementations, wherein the control unit includes an input element configured to receive an input signal from a user, and wherein the housing panel includes an input feature configured to allow the input signal to pass therethrough.

Example Implementation 39: The aerosol delivery device of any of Example Implementations 31-38, or any combination of preceding example implementations, wherein the input element of the control unit comprises a button, and wherein the input feature of the housing panel comprises an aperture that extends through the housing panel.

Example Implementation 40: The aerosol delivery device of any of Example Implementations 31-39, or any combination of preceding example implementations, wherein the input element of the control unit comprises a button, and wherein the input feature of the housing panel comprises a corresponding button of the housing panel.

Example Implementation 41: The aerosol delivery device of any of Example Implementations 31-40, or any combination of preceding example implementations, wherein one or both of the body frame of the control unit or the housing panel includes a securing feature configured to releasably secure the housing panel to the body frame.

Example Implementation 42: The aerosol delivery device of any of Example Implementations 31-41, or any combination of preceding example implementations, wherein the securing feature comprises one or more of a magnetic securing feature, a detent securing feature, a spring-loaded securing feature, or any combination thereof.

Example Implementation 43: The aerosol delivery device of any of Example Implementations 31-42, or any combination of preceding example implementations, wherein the securing feature comprises a friction interface between the housing panel and the body frame.

Example Implementation 44: The aerosol delivery device of any of Example Implementations 31-43, or any combination of preceding example implementations, wherein the body frame of the control unit includes an electrical connection element proximate a distal end thereof, wherein the housing panel includes an electrical connector proximate a distal end thereof, and wherein the electrical connector of the housing panel is configured to couple with the electrical connection element of the body frame.

Example Implementation 45: The aerosol delivery device of any of Example Implementations 31-44, or any combination of preceding example implementations, wherein the housing panel includes a power source configured to provide power to the control unit via the electrical connector and electrical connection element.

Example Implementation 46: An aerosol delivery device comprising a control unit that includes a body frame having a proximal end and a distal end, the proximal end of the body frame defining at least a portion of a receiving chamber, a removable and replaceable aerosol precursor consumable, at least a portion of the consumable configured to be received into the receiving chamber, and a removable and replaceable housing panel configured to be releasably received onto the body frame of the control unit, the housing panel including a rail feature, wherein the housing panel forms part of an outer surface of the control unit, and wherein the body frame includes a complementary rail feature configured to slidably engage with the rail feature of the housing panel.

Example Implementation 47: The aerosol delivery device of Example Implementation 46, or any combination of preceding example implementations, wherein the housing panel forms a single outer surface of the aerosol delivery device.

Example Implementation 48: The aerosol delivery device of any of Example Implementations 46-47, or any combination of preceding example implementations, wherein the housing panel forms two or more outer surfaces of the aerosol delivery device.

Example Implementation 49: The aerosol delivery device of any of Example Implementations 46-48, or any combination of preceding example implementations, wherein the body frame defines a first portion of the receiving chamber, and wherein the housing panel forms a second portion of the receiving chamber.

Example Implementation 50: The aerosol delivery device of any of Example Implementations 46-49, or any combination of preceding example implementations, wherein the housing panel includes a customizable feature comprising one or more of a surface color of the housing panel, a surface contour of the housing panel, a surface pattern of the housing panel, a surface texture of the housing panel, one or more surface projections of the housing panel, a profile of the housing panel, a material of the housing panel, or any combination thereof.

Example Implementation 51: The aerosol delivery device of any of Example Implementations 46-50, or any combination of preceding example implementations, wherein the control unit includes an output element configured to provide a visually perceptible output signal, and wherein the housing panel includes an output feature configured to allow the output signal to pass therethrough.

Example Implementation 52: The aerosol delivery device of any of Example Implementations 46-51, or any combination of preceding example implementations, wherein the output feature of the housing panel comprises one or more of an aperture that extends through the housing panel, a series of microperforations that extend through the housing panel, a light tube configured to transmit the output signal through the housing panel, or any combination thereof.

Example Implementation 53: The aerosol delivery device of any of Example Implementations 46-52, or any combination of preceding example implementations, wherein the control unit includes an input element configured to receive an input signal from a user, and wherein the housing panel includes an input feature configured to allow the input signal to pass therethrough.

Example Implementation 54: The aerosol delivery device of any of Example Implementations 46-53, or any combination of preceding example implementations, wherein the input element of the control unit comprises a button, and wherein the input feature of the housing panel comprises an aperture that extends through the housing panel.

Example Implementation 55: The aerosol delivery device of any of Example Implementations 46-54, or any combination of preceding example implementations, wherein the input feature of the housing panel comprises or a corresponding button of the housing panel.

Example Implementation 56: The aerosol delivery device of any of Example Implementations 46-55, or any combination of preceding example implementations, wherein one or both of the body frame of the control unit or the housing panel includes a securing feature configured to releasably secure the housing panel to the body frame.

Example Implementation 57: The aerosol delivery device of any of Example Implementations 46-56, or any combination of preceding example implementations, wherein the securing feature comprises one or more of a magnetic securing feature, a detent securing feature, a spring-loaded securing feature, or any combination thereof.

Example Implementation 58: The aerosol delivery device of any of Example Implementations 46-57, or any combination of preceding example implementations, wherein the securing feature comprises a friction interface between the housing panel and the body frame.

Example Implementation 59: The aerosol delivery device of any of Example Implementations 46-58, or any combination of preceding example implementations, wherein the body frame of the control unit includes an electrical connection element proximate a distal end thereof, wherein the housing panel includes an electrical connector proximate a distal end thereof, and wherein the electrical connector of the housing panel is configured to couple with the electrical connection element of the body frame.

Example Implementation 60: The aerosol delivery device of any of Example Implementations 46-59, or any combination of preceding example implementations, wherein the housing panel includes a power source configured to provide power to the control unit via the electrical connector and electrical connection element.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE FIGURES

Figure 1:
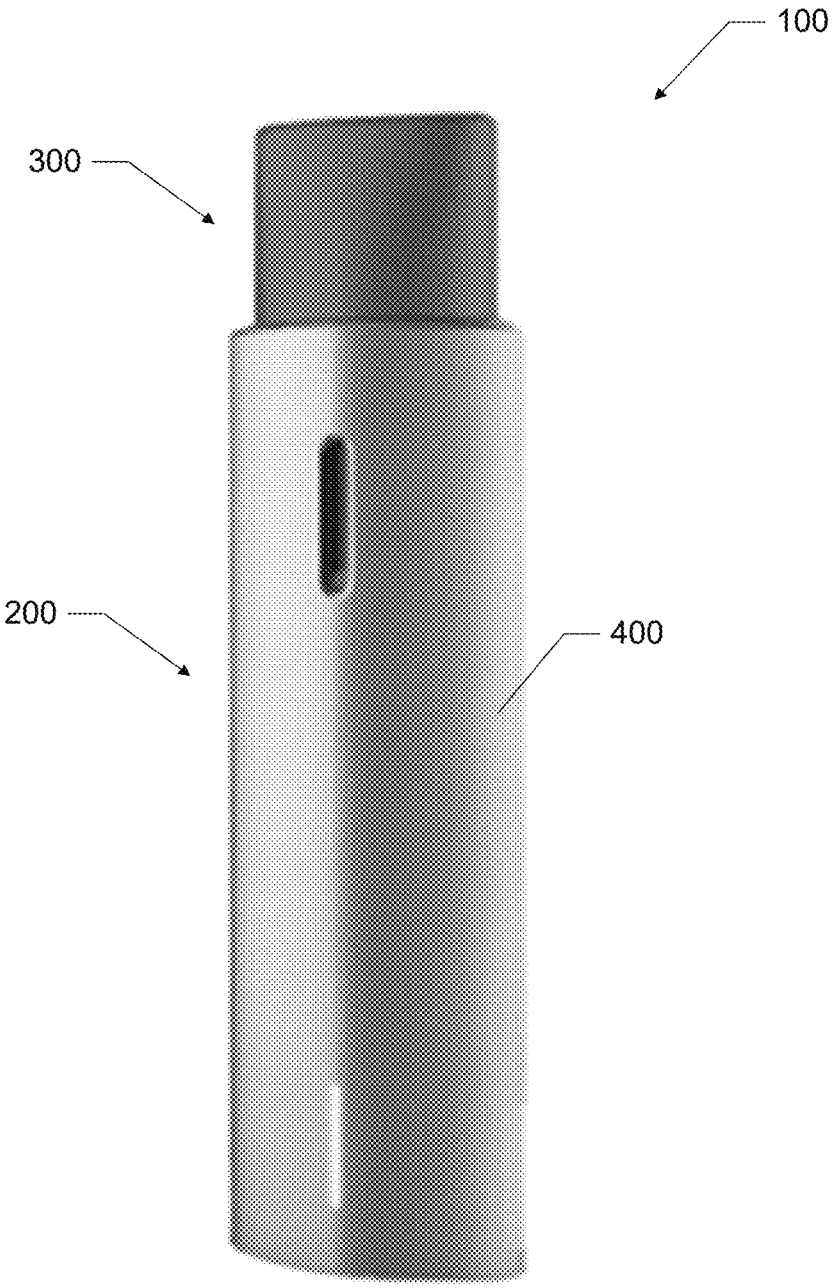
Figure 2:
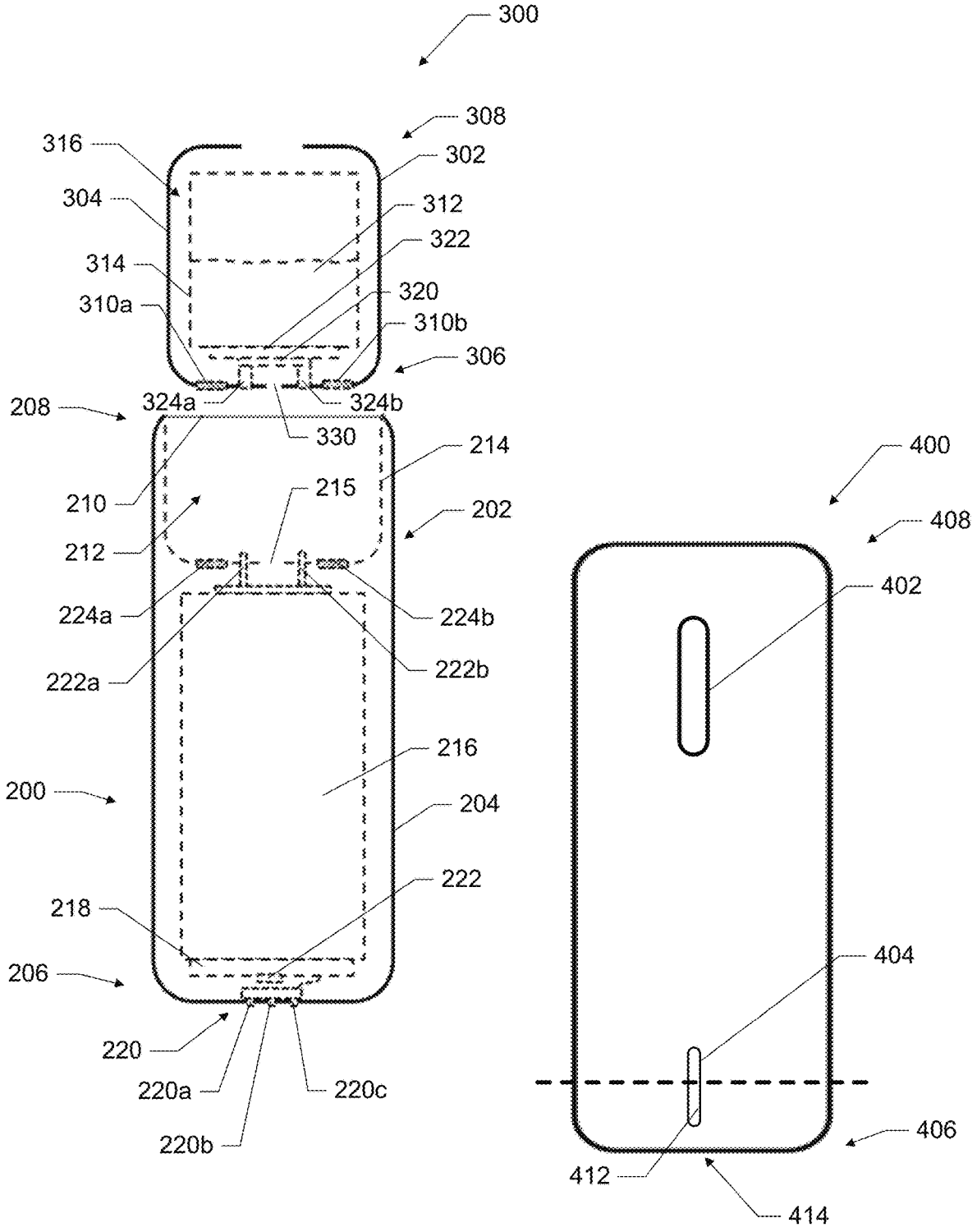
Figure 3:
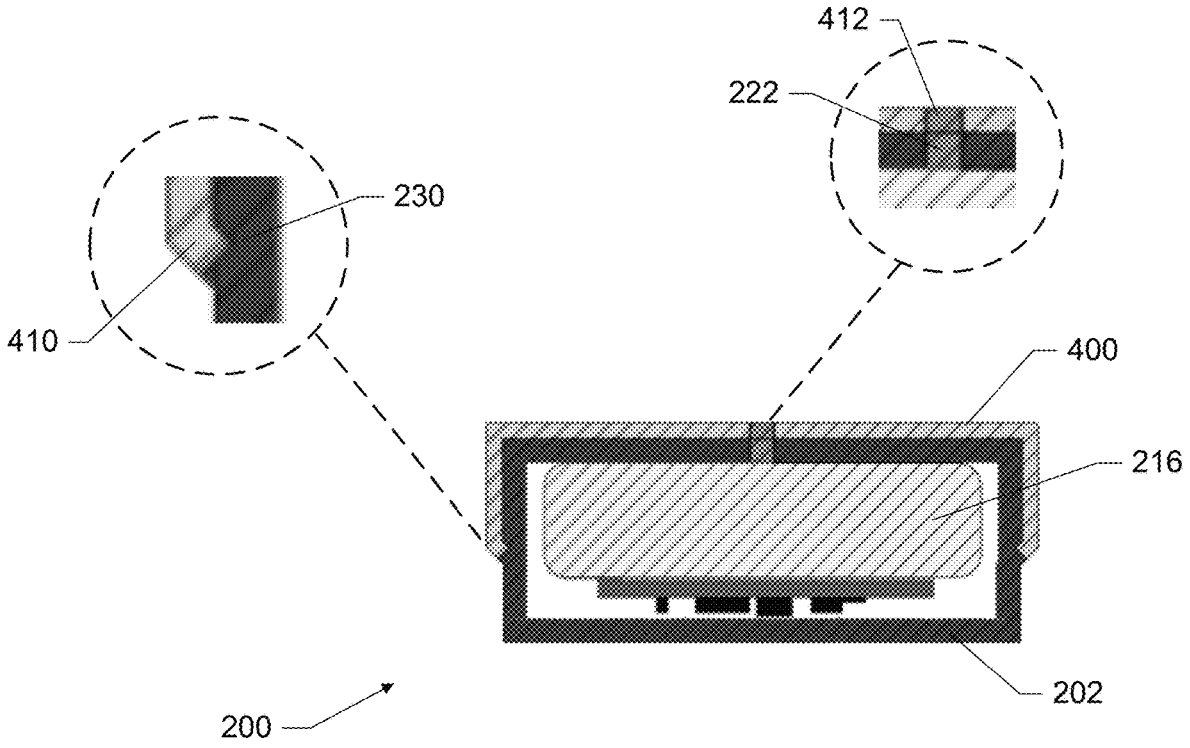
Figure 4:
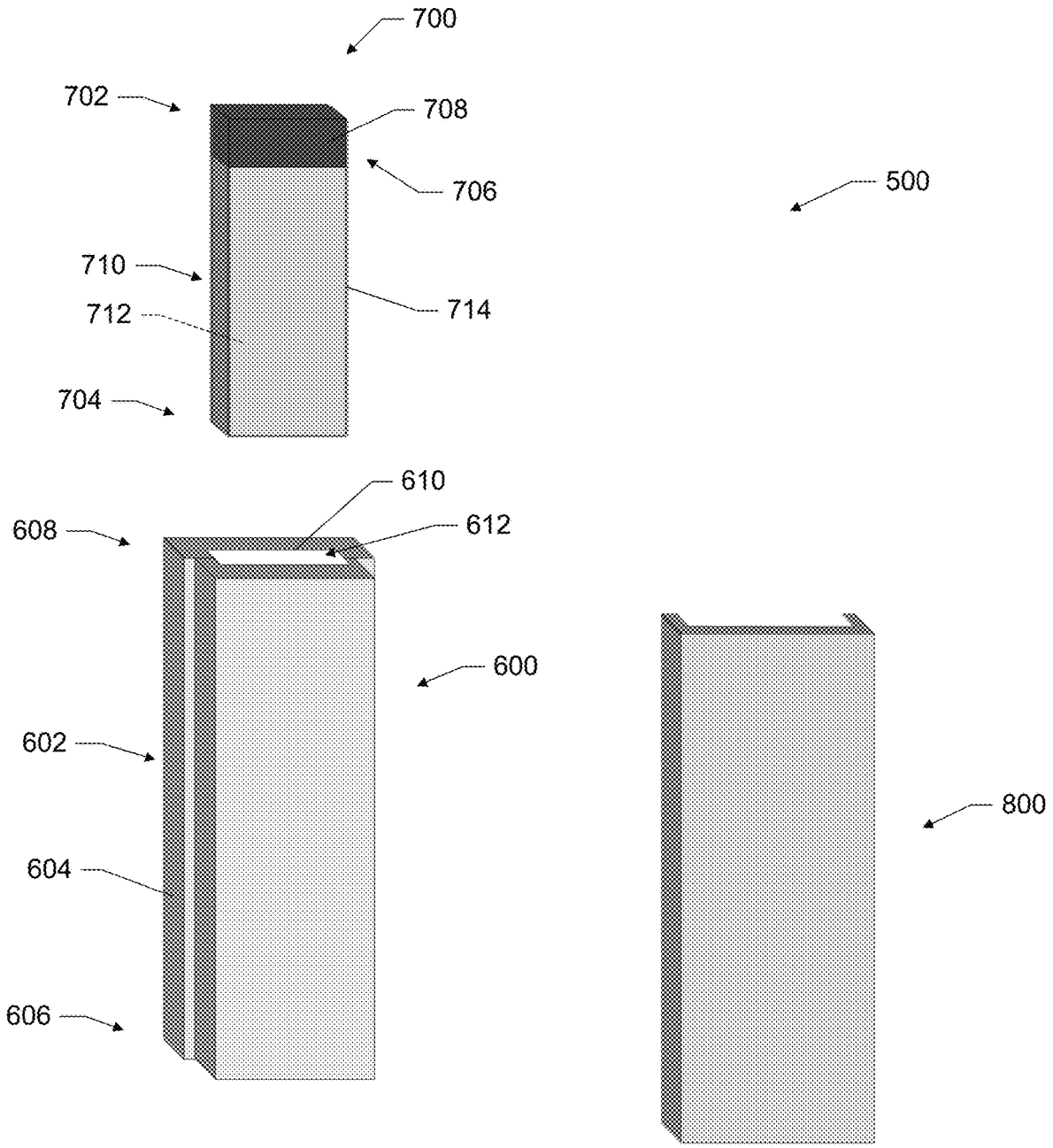
Figure 5:
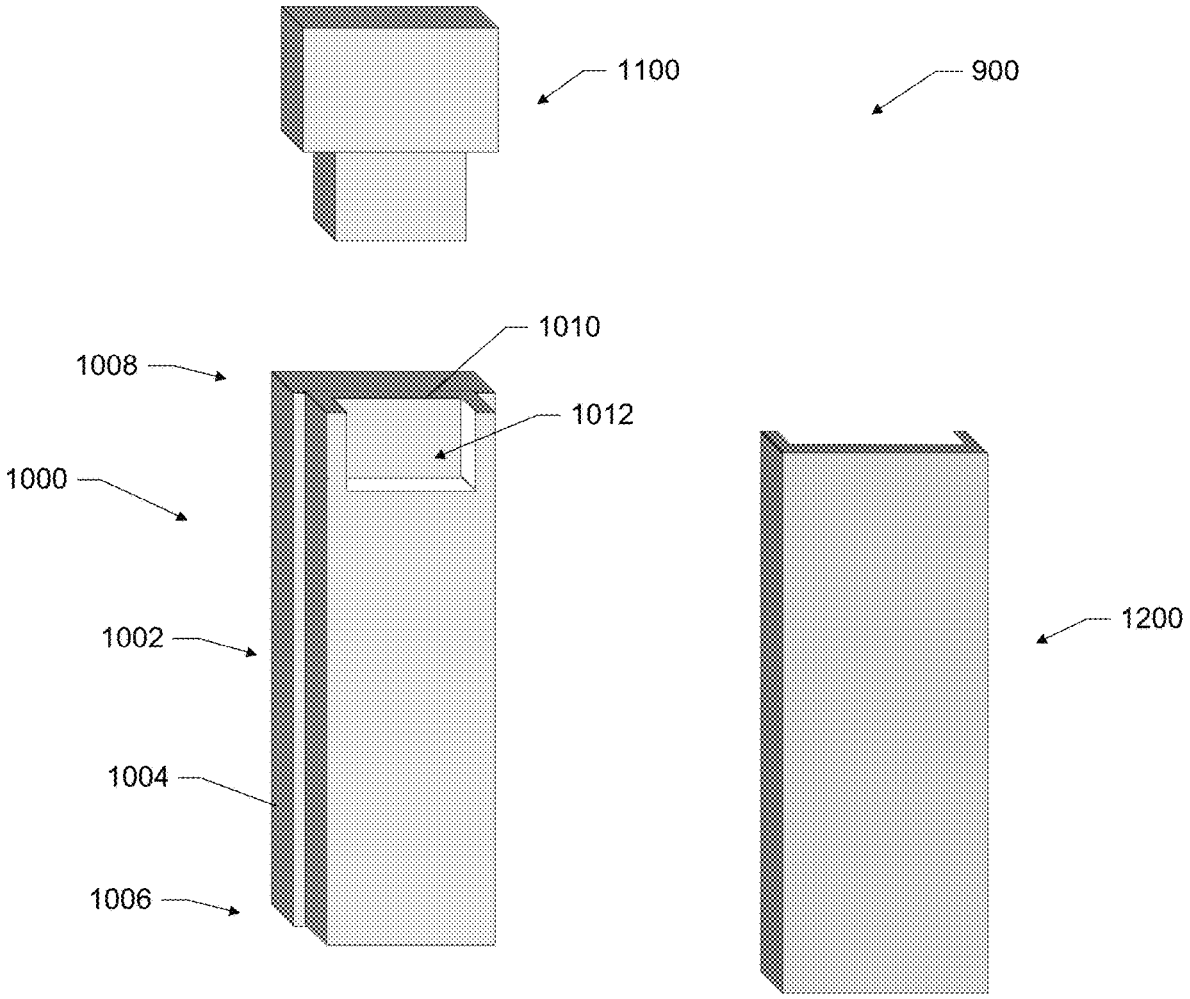

Having thus described the disclosure in the foregoing general terms, reference will now be made to the accompanying drawings, which are not necessarily drawn to scale, and wherein:

FIG. 1 is a perspective view of an aerosol delivery device, according to an example implementation of the present disclosure;

FIG. 2 is an exploded view of an aerosol delivery device, according to an example implementation of the present disclosure;

FIG. 3 is a cross-sectional view of a portion of a control unit, according to an example implementation of the present disclosure;

FIG. 4 is an exploded view of an aerosol delivery device, according to an example implementation of the present disclosure; and FIG. 5 is an exploded view of an aerosol delivery device, according to an example implementation of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

As described hereinafter, implementations of the present disclosure relate to aerosol delivery devices or vaporization devices, said terms being used herein interchangeably. Aerosol delivery devices according to the present disclosure use electrical energy and/or an ignitable heat source to vaporize and/or aerosolize a material to form an inhalable substance; and components of such devices have the form of articles that most preferably are sufficiently compact to be considered hand-held devices. In some embodiments, the present aerosol delivery devices may be configured to heat a material (preferably without combusting the material to any significant degree and/or without significant chemical alteration of the material) to form the inhalable substance. Preferably, use of components of preferred aerosol delivery devices does not result in the production of smoke—i.e., from by-products of combustion or pyrolysis of tobacco, but rather, use of those preferred systems results in the production of vapors resulting from volatilization or vaporization of certain components incorporated therein. In some implementations, components of aerosol delivery devices may be characterized as electronic cigarettes, and those electronic cigarettes most preferably incorporate tobacco and/or components derived from tobacco, and hence deliver tobacco derived components in aerosol form.

As noted, some implementations of aerosol delivery devices according to the present disclosure use electrical energy to energize a material to form an inhalable substance. For example, some implementations of aerosol delivery device according to the present disclosure use electrical energy to heat a material to form an inhalable substance (e.g., electrically heated tobacco products), and other implementations of aerosol delivery devices according to the present disclosure use electrical energy to vibrate a material to form an inhalable substance. Still other implementations of aerosol source members according to the present disclosure use an ignitable heat source to heat a material to form an inhalable substance (e.g., carbon heated tobacco products). The material may be heated without combusting the material to any significant degree. As such, the presently disclosed subject matter may be used in relation to a variety of aerosol and/or vapor producing devices, which may include, but is not limited to, devices commonly known as e-cigarettes, heat-not-burn (HNB) devices, carbon tobacco heated products (cTHP), and electric tobacco heated products (eTHP). Non-limiting examples of such devices to which any part or all of the present disclosure may be incorporated are described in U.S. Pat. Nos. 9,839,238, 9,913,493, 10,085,485, and 10,349,674, each of which is incorporated herein in its entirety.

Components of such systems have the form of articles that are sufficiently compact to be considered hand-held devices. That is, use of components of aerosol delivery devices does not result in the production of smoke in the sense that aerosol results principally from by-products of combustion or pyrolysis of tobacco, but rather, use of those systems results in the production of vapors resulting from volatilization or vaporization of certain components incorporated therein. In some example embodiments, components of aerosol delivery devices may be characterized as electronic cigarettes, and those electronic cigarettes may incorporate tobacco and/or components derived from tobacco, and hence deliver tobacco derived components in aerosol form.

Aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe that is employed by lighting and burning tobacco (and hence inhaling tobacco smoke), without any substantial degree of combustion of any component thereof. For example, the user of an aerosol generating device of the present disclosure can hold and use that piece much like a smoker employs a traditional type of smoking article, draw on one end of that piece for inhalation of aerosol produced by that piece, take or draw puffs at selected intervals of time, and the like.

Aerosol delivery devices of the present disclosure can also be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like.

Some aerosol delivery devices of the present disclosure comprise some combination of a power source (i.e., an electrical power source), at least one control component (e.g., means for actuating, controlling, regulating and ceasing power for heat generation, such as by controlling electrical current flow from the power source to other components of the article—e.g., a microcontroller or microprocessor), an atomizer, a liquid composition (e.g., commonly an aerosol precursor composition liquid capable of yielding an aerosol upon application of sufficient heat, such as ingredients commonly referred to as "smoke juice," "e-liquid" and "e-juice"), and a mouthpiece or mouth region for allowing draw upon the aerosol delivery device for aerosol inhalation (e.g., a defined airflow path through the article such that aerosol generated can be withdrawn therefrom upon draw). More specific formats, configurations and arrangements of components within the aerosol delivery devices of the present disclosure will be evident in light of the further disclosure provided hereinafter. Additionally, the selection and arrangement of various aerosol delivery device components can be appreciated upon consideration of the commercially available electronic aerosol delivery devices, such as those representative products referenced in the background art section of the present disclosure.

An example implementation of an aerosol delivery device 100 of the present disclosure is shown in FIGS. 1 and 2. In general, the depicted implementation includes an aerosol delivery device 100 that comprises a control unit 200, a removable aerosol precursor consumable 300, and a housing panel 400, which forms part of an outer surface of the control unit 200. The removable aerosol precursor consumable 300 of the depicted implementation represents one example of an aerosol precursor consumable in the form of a liquid composition cartridge; however, aerosol precursor consumables of other implementations may differ. In the depicted implementation, the housing panel 400 is removable and replaceable. As further described elsewhere herein, the control unit 200 is configured to receive a portion of the aerosol precursor consumable 300.

Referring to FIG. 2, the aerosol delivery device 100 of the depicted implementation can include a variety of further components. As noted above, the aerosol delivery device 100 includes a control unit 200, an aerosol precursor consumable 300, and a housing panel 400, which forms part of an outer surface of the control unit 200. In the depicted implementation, the aerosol precursor consumable 300 is engageable with the control unit 200 to form an operating aerosol delivery device 100, and the aerosol precursor consumable 300 is removable therefrom.

In the depicted implementation, the control unit 200 includes a body frame 202 that defines a control unit outer wall 204, a control unit distal end 206, and a control unit proximal end 208. The control unit proximal end 208 includes an opening 210 that provides access to a receiving chamber 212 that is defined, in the depicted implementation, by a control unit inner frame 214. As such, the receiving chamber 212 of the depicted implementation is defined by the control unit 200. As will be described below, the receiving chamber of other implementations may be defined in part by the control unit and in part by the housing panel.

In some implementations, the control unit inner frame 214 may include an aperture 215 that can be configured for transferring pressure differentials therethrough to a pressure sensor (not shown) positioned within the control unit 200 when air is drawn into the receiving chamber 212. In some implementations, the pressure sensor may be positioned on a printed circuit board (PCB) located in the control unit. In other implementations, however, a pressure sensor may have any location. In addition, some implementations need not include a pressure sensor. Some example configurations of a PCB and a pressure sensor, for example, are described in U.S. Pat. Pub. No. 2015/0245658 to Worm et al., the disclosure of which is incorporated herein by reference in its entirety. In various implementations, a pressure sensor may be positioned anywhere within the control unit so as to subject to airflow and/or a pressure change that can signal a draw on the device and thus cause the atomizer to activate.

The control unit 200 of the depicted implementation also includes a power source, such as a battery 216. Some examples of batteries that can be used according to the disclosure are described in U.S. Pat. Pub. No. 2010/0028766 to Peckerar et al., the disclosure of which is incorporated herein by reference. In the depicted implementation, a draw on the device 100 causes the battery 216 to delivery power to an atomizer located in the aerosol precursor consumable 300. In the absence of a pressure or airflow sensor, the atomizer of some implementations may be activated manually, such as via one or more push buttons. Additional examples of sensing or detection mechanisms, structures, configurations thereof, components thereof, and general methods of operation thereof, are described in U.S. Pat. No. 5,261,424 to Sprinkel, Jr.; U.S. Pat. No. 5,372,148 to McCafferty et al.; and PCT WO 2010/003480 to Flick; each of which is incorporated herein by reference in its entirety.

The control unit 200 of the depicted implementation also includes at least one control component 218. In the depicted implementation, the control component 218 is located on a printed circuit board (PCB), and the battery 216 is positioned within the control unit body frame 202. In the depicted implementation, the control unit 200 also includes an external connection element 220, which is positioned proximate the distal end 206 of the control unit body frame 202. Although in various implementations an external connection element may have a variety of configurations, in the depicted implementation the external connection element 220 is formed of a plurality of electrical connectors (220*a*, 220*b*, 220*c*). In some implementations, the control unit may include an output element configured to provide visually perceptible output signal. In the depicted implementation, for example, the control unit 200 also includes a light source 222 that may comprise, for example, one or more light emitting diodes (LEDs) capable of providing one or more colors of lighting. In the depicted implementation, the light source 222 is positioned directly on the PCB that contains the control component 218. In various implementations, the PCB may include further control components (e.g., a microcontroller and/or memory components). In the depicted implementation, the LEDs may, for example, be selected of a design to emit light substantially upward from the plane of the PCB. Alternatively, or additionally, suitable LEDs may include reflector elements adapted to or configured to emit light in a substantially different direction, such as parallel to the plane of the PCB, or at a desired angle that provides the desired result. In the depicted implementation, the pressure sensor and the external connection element 220 are likewise directly attached to the PCB or otherwise electrically connected to the PCB.

In the depicted implementation, the control unit 200 further includes electrical pins 222*a*, 222*b* that are positioned in the receiving chamber 212 for forming an electrical connection with the aerosol precursor consumable 300 upon insertion of the consumable 300 into the receiving chamber 212. As illustrated, the electrical pins 222*a*, 222*b* are positioned proximate a bottom portion of the receiving chamber 212 and extend through a bottom wall of the inner frame 214, which defines the boundaries of the receiving chamber 212. In the depicted implementation, one or more mechanical connectors 224*a*, 224*b* are present in the receiving chamber 212, and are positioned in the inner frame 214, and in particular, in the bottom wall thereof. In some implementations, the mechanical connectors may be magnetic elements (e.g., magnets or elements formed of material configured for forming a magnetic connection with a further magnet). Alternatively, or additionally, the mechanical connectors may be positioned in a side wall of the inner frame and thus may be configure for establishing a friction or other mechanical fit with a removable and replaceable aerosol precursor consumable.

In various implementations, the control unit body frame 202 may be formed of any suitable material, such as a metal, plastic, ceramic, glass, or the like. In some implementations, the control unit inner frame is formed of the same material as used to form the control unit body frame; however, in other implementations, different materials may be used. Although the control unit inner frame 214 of the depicted implementation is illustrated as being a separate element from the control unit body frame 202, it is understood that, if desired, the inner frame may be defined by an internal surface of the body frame and may thus form a common part. Some implementations may include an added bottom plate (e.g., such that the bottom plate corresponds to the depicted inner frame bottom wall, and the internal surface of the outer housing corresponds to the illustrated inner frame side wall).

In the depicted implementation, the control unit 200 is configured to receive an aerosol precursor consumable 300 to provide a functioning aerosol delivery device 100. In the depicted implementation, the aerosol precursor consumable 300 defines a consumable body 302 that includes an outer tank wall 304 and defines a distal end 306 and a proximal end 308. In the depicted implementation, mating connectors 310*a*, 310*b* are located proximate the distal end 306 of the aerosol precursor consumable 300 and are configured to form a connection with the mechanical connectors 224*a*, 224*b* present in the receiving chamber 212 of the control unit 200. As noted above, mechanical connectors of the control unit of some implementations may comprise magnetic elements. As such, the aerosol precursor consumable of some implementations may include mating magnetic connectors. Alternatively, or additionally, other complementary mechanical connectors may be located on the aerosol precursor consumable (e.g., on one or more sides of the outer wall and thus may be configured for establishing a friction fit or other mechanical fit with the receiving chamber of the control unit).

In the depicted implementation, the aerosol precursor consumable 300 is configured to contain a liquid composition 312 for vaporization—i.e., an e-liquid or aerosol precursor composition, which may be configured as otherwise described herein. The liquid composition, sometimes referred to as an aerosol precursor composition or a vapor precursor composition or "e-liquid", may comprise a variety of components, which may include, by way of example, a polyhydric alcohol (e.g., glycerin, propylene glycol, or a mixture thereof), nicotine, tobacco, tobacco extract, and/or flavorants. Representative types of aerosol precursor components and formulations are also set forth and characterized in U.S. Pat. No. 7,217,320 to Robinson et al. and U.S. Pat. App. Pub. Nos. 2013/0008457 to Zheng et al.; 2013/0213417 to Chong et al.; 2014/0060554 to Collett et al.; 2015/0020823 to Lipowicz et al.; and 2015/0020830 to Koller, as well as WO 2014/182736 to Bowen et al, the disclosures of which are incorporated herein by reference in their entireties. Other aerosol precursors that may be employed include the aerosol precursors that have been incorporated in VUSE® products by R. J. Reynolds Vapor Company, the BLU™ products by Fontem Ventures B. V., the MISTIC MENTHOL product by Mistic Ecigs, MARK TEN products by Nu Mark LLC, the JUUL product by Juul Labs, Inc., and VYPE products by CN Creative Ltd. Also desirable are the so-called "smoke juices" for electronic cigarettes that have been available from Johnson Creek Enterprises LLC. Still further example aerosol precursor compositions are sold under the brand names BLACK NOTE, COSMIC FOG, THE MILKMAN E-LIQUID, FIVE PAWNS, THE VAPOR CHEF, VAPE WILD, BOOSTED, THE STEAM FACTORY, MECH SAUCE, CASEY JONES MAINLINE RESERVE, MITTEN VAPORS, DR. CRIMMY'S V-LIQUID, SMILEY E LIQUID, BEANTOWN VAPOR, CUTTWOOD, CYCLOPS VAPOR, SICBOY, GOOD LIFE VAPOR, TELEOS, PINUP VAPORS, SPACE JAM, MT. BAKER VAPOR, and JIMMY THE JUICE MAN.

The amount of aerosol precursor composition that is incorporated within the aerosol delivery system is such that the aerosol generating device provides acceptable sensory and desirable performance characteristics. For example, sufficient amounts of aerosol forming material (e.g., glycerin and/or propylene glycol) may be employed in order to provide for the generation of a visible mainstream aerosol that in many regards resembles the appearance of tobacco smoke. The amount of aerosol precursor within the aerosol generating system may be dependent upon factors such as the number of puffs desired per aerosol generating device. In one or more embodiments, about 1 ml or more, about 2 ml or more, about 5 ml or more, or about 10 ml or more of the aerosol precursor composition may be included.

In the some of the examples described above, the aerosol precursor composition comprises a glycerol-based liquid. In other implementations, however, the aerosol precursor composition may be a water-based liquid. In some implementations, the water-based liquid may be comprised of more than approximately 80% water. For example, in some implementations the percentage of water in the water-based liquid may be in the inclusive range of approximately 90% to approximately 93%. In some implementations, the water-based liquid may include up to approximately 10% propylene glycol. For example, in some implementations the percentage of propylene glycol in the water-based liquid may be in the inclusive range of approximately 4% to approximately 5%. In some implementations, the water-based liquid may include up to approximately 10% flavorant. For example, in some implementations the percentage of flavorant(s) of the water-based liquid may be in the inclusive range of approximately 3% to approximately 7%. In some implementations, the water-based liquid may include up to approximately 1% nicotine. For example, in some implementations the percentage nicotine in the water-based liquid may be in the inclusive range of approximately 0.1% to approximately 1%. In some implementations, the water-based liquid may include up to approximately 10% cyclodextrin. For example, in some implementations the percentage cyclodextrin in the water-based liquid may be in the inclusive range of approximately 3% to 5%. In still other implementations, the aerosol precursor composition may be a combination of a glycerol-based liquid and a water-based liquid. For example, some implementations may include up to approximately 50% water and less than approximately 20% glycerol. The remaining components may include one or more of propylene glycol, flavorants, nicotine, cyclodextrin, etc. Some examples of water-based liquid compositions that may be suitable are disclosed in GB 1817863.2, filed Nov. 1, 2018, titled *Aerosolisable Formulation*; GB 1817864.0, filed Nov. 1, 2018, titled *Aerosolisable Formulation*; GB 1817867.3, filed Nov. 1, 2018, titled *Aerosolisable Formulation*; GB 1817865.7, filed Nov. 1, 2018, titled *Aerosolisable Formulation*; GB 1817859.0, filed Nov. 1, 2018, titled *Aerosolisable Formulation*; GB 1817866.5, filed Nov. 1, 2018, titled *Aerosolisable Formulation*; GB 1817861.6, filed Nov. 1, 2018, titled *Gel and Crystalline Powder*; GB 1817862.4, filed Nov. 1, 2018, titled *Aerosolisable Formulation*; GB 1817868.1, filed Nov. 1, 2018, titled *Aerosolised Formulation*; and GB 1817860.8, filed Nov. 1, 2018, titled *Aerosolised Formulation*, each of which is incorporated by reference herein in its entirety.

In some implementations, the aerosol precursor composition may incorporate nicotine, which may be present in various concentrations. The source of nicotine may vary, and the nicotine incorporated in the aerosol precursor composition may derive from a single source or a combination of two or more sources. For example, in some implementations the aerosol precursor composition may include nicotine derived from tobacco. In other implementations, the aerosol precursor composition may include nicotine derived from other organic plant sources, such as, for example, non-tobacco plant sources including plants in the Solanaceae family. In other implementations, the aerosol precursor composition may include synthetic nicotine. In some implementations, nicotine incorporated in the aerosol precursor composition may be derived from non-tobacco plant sources, such as other members of the Solanaceae family. The aerosol precursor composition may additionally or alternatively include other active ingredients including, but not limited to, botanical ingredients (e.g., lavender, peppermint, chamomile, basil, rosemary, thyme, eucalyptus, ginger, cannabis, ginseng, maca, and tisanes), melatonin, stimulants (e.g., caffeine, theine, and guarana), amino acids (e.g., taurine, theanine, phenylalanine, tyrosine, and tryptophan) and/or pharmaceutical, nutraceutical, nootropic, psychoactive, and medicinal ingredients (e.g., vitamins, such as B6, B12, and C and cannabinoids, such as tetrahydrocannabinol (THC) and cannabidiol (CBD)). It should be noted that the aerosol precursor composition may comprise any constituents, derivatives, or combinations of any of the above.

As noted herein, the aerosol precursor composition may comprise or be derived from one or more botanicals or constituents, derivatives, or extracts thereof. As used herein, the term "botanical" includes any material derived from plants including, but not limited to, extracts, leaves, bark, fibres, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha* Arventis, *Mentha* c.v., *Mentha niliaca, Mentha piperita, Mentha piperita citrata* c.v., *Mentha piperita* c.v, *Mentha spicata crispa, Mentha cardifolia, Mentha longifolia, Mentha suaveolens variegata, Mentha pulegium, Mentha spicata* c.v. and *Mentha suaveolens.*

As noted above, in various implementations, the liquid composition may include a flavorant or materials that alter the sensory or organoleptic character or nature of the aerosol of the smoking article. In some implementations, the flavorant may be pre-mixed with the liquid. In other implementations, the flavorant may be delivered separately downstream from the atomizer as a main or secondary flavor. Still other implementations may combine a pre-mixed flavorant with a downstream flavorant. As used herein, reference to a "flavorant" refers to compounds or components that can be aerosolized and delivered to a user and which impart a sensory experience in terms of taste and/or aroma. Example flavorants include, but are not limited to, vanillin, ethyl vanillin, cream, tea, coffee, fruit (e.g., apple, cherry, strawberry, peach and citrus flavors, including lime, lemon, mango, and other citrus flavors), maple, menthol, mint, peppermint, spearmint, wintergreen, nutmeg, clove, lavender, cardamom, ginger, honey, anise, sage, rosemary, hibiscus, rose hip, yerba mate, guayusa, honeybush, rooibos, amaretto, mojito, yerba santa, ginseng, chamomile, turmeric, bacopa monniera, gingko biloba, withania somnifera, cinnamon, sandalwood, jasmine, cascarilla, cocoa, licorice, and flavorings and flavor packages of the type and character traditionally used for the flavoring of cigarette, cigar, and pipe tobaccos. Other examples include flavorants derived from, or simulating, burley, oriental tobacco, flue cured tobacco, etc. Syrups, such as high fructose corn syrup, also can be employed. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. The selection of such further components are variable based upon factors such as the sensory characteristics that are desired for the smoking article, and the present disclosure is intended to encompass any such further components that are readily apparent to those skilled in the art of tobacco and tobacco-related or tobacco-derived products. See, e.g., Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties. It should be noted that reference to a flavorant should not be limited to any single flavorant as described above, and may, in fact, represent a combination of one or more flavorants.

As used herein, the terms "flavor," "flavorant," "flavoring agents," etc. refer to materials which, where local regulations permit, may be used to create a desired taste, aroma, or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus Mentha, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some implementations, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis.

In some implementations, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to, eucolyptol or WS-3.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In the depicted implementation, the aerosol precursor consumable 300 includes a reservoir 314 wherein the e-liquid or the like may be retained. In the depicted implementation, an aerosol passage 316 at least partially surrounds the reservoir 314 in a longitudinal direction from the distal end 306 to the proximal end 308 of the consumable 300. In other implementations, however, it is understood that the aerosol passage may extend through at least a portion of the reservoir such that the reservoir is configured in an annular space between the aerosol passage and the consumable outer wall.

In the depicted implementation, the consumable 300 further includes a mouthpiece portion that is defined as a portion of the proximal end 308 of the consumable 300 that a user engages in order to draw on the device 100. Although in the depicted implementation, the mouthpiece portion is integral with the consumable body 302, in other implementations, the mouthpiece portion may be a separate element from the consumable body. In such implementations, the mouthpiece portion may be attachable to the consumable body. In the depicted implementation, the aerosol precursor consumable 300 further includes an atomizer 320 that includes a liquid transport element 322. In the depicted implementation, the atomizer 320 comprises a heater and the liquid transport element 322 defines a fluid connection between the heater and liquid in the reservoir 314. In other implementations, the atomizer may comprise a vibrating assembly and the liquid transport element may define a fluid connection between the vibrating assembly and liquid in the reservoir.

In the depicted implementation, the atomizer 320 and liquid transport element 322 are configured as separate elements that are fluidly connected. In other implementations, these components may be combined. Still other implementations need not include a liquid transport element. In the depicted implementation, the aerosol precursor consumable 300 includes one or more electrical contacts 324*a*, 324*b* that are configured to electrically connect the atomizer 320 with the battery 216 in the control unit 200 through contact with the electrical pins 222*a*, 222*b* when the aerosol precursor consumable 300 is received in the receiving chamber 212 of the control unit 200.

In various implementations, a liquid transport element may be formed of one or more materials configured for transport of a liquid, such as by capillary action. In some implementations, for example, a liquid transport element may be formed of, for example, fibrous materials (e.g., organic cotton, cellulose acetate, regenerated cellulose fabrics, glass fibers), porous ceramics, porous carbon, graphite, porous glass, sintered glass beads, sintered ceramic beads, capillary tubes, or the like. The liquid transport element thus may be any material that contains an open pore network (i.e., a plurality of pores that are interconnected so that fluid may flow from one pore to another in a plurality of direction through the element). Some implementations of the present disclosure may particularly relate to the use of non-fibrous transport elements. As such, in such embodiments, fibrous transport elements can be expressly excluded. Alternatively, combinations of fibrous transport elements and non-fibrous transport elements may be utilized. Representative types of substrates, reservoirs or other components for supporting the aerosol precursor are described in U.S. Pat. No. 8,528,569 to Newton; U.S. Pat. Pub. Nos. 2014/0261487 to Chapman et al. and 2014/0059780 to Davis et al.; and U.S. Pub. No. 2015/0216232 to Bless et al.; which are incorporated herein by reference. Additionally, various wicking materials, and the configuration and operation of those wicking materials within certain types of electronic cigarettes, are set forth in U.S. Pat. No. 8,910,640 to Sears et al.; which is incorporated herein by reference. In some implementations, a liquid transport element can be formed partially or completely from a porous monolith, such as a porous ceramic, a porous glass, or the like. Example monolithic materials suitable for use according to embodiments of the present disclosure are described, for example, in U.S. Pat. Pub. Nos. 2014/0123989 to LaMothe and 2017/0188626 to Davis et al., the disclosures of which are incorporated herein by reference. The porous monolith can form a substantially solid wick.

As noted, in the depicted implementation the atomizer 320 comprises a heater. Various implementations of materials configured to produce heat when electrical current is applied therethrough may be employed to form the heater of the depicted implementation. In some implementations, for example, the heater may comprise a wire coil. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), titanium, platinum, silver, palladium, alloys of silver and palladium, graphite and graphite-based materials (e.g., carbon-based foams and yarns). In further implementations, the heater may be formed from conductive inks, boron doped silica, and/or ceramics (e.g., positive or negative temperature coefficient ceramics). Other types of heaters may also be utilized, such as, for example, laser diodes and/or microheaters. A laser diode may be configured to deliver electromagnetic radiation at a specific wavelength or band of wavelengths that can be tuned for vaporization of the aerosol precursor composition and/or tuned for heating a liquid transport element via which the aerosol precursor composition may be provided for vaporization. The laser diode may particularly be positioned so as to deliver the electromagnetic radiation within a chamber, and the chamber may be configured to be radiation-trapping (e.g., a black body or a white body). Suitable microheaters are described in U.S. Pat. No. 8,881,737 to Collett et al., which is incorporated herein by reference. Microheaters, for example, can comprise a substrate (e.g., quartz, silica) with a heater trace thereon (e.g., a resistive element such as Ag, Pd, Ti, Pt, Pt/Ti, boron-doped silicon, or other metals or metal alloys), which may be printed or otherwise applied to the substrate. A passivating layer (e.g., aluminum oxide or silica) may be provided over the heater trace. The heater in particular may be configured to be substantially flat. Such heaters are described in U.S. Pat. Pub. No. 2016/0345633 to DePiano et al., which is incorporated herein by reference.

As noted, further types of atomizer are also encompassed by the present disclosure. For example, in some implementations, an atomizer may comprise one or more elements adapted to or configured vaporize or aerosolize (or otherwise form a fine, particulate form of) an aerosol precursor liquid without necessarily heating the liquid. For example, a piezo element may be used as a vaporizer in certain embodiments of the present disclosure, and suitable piezo elements are described, for example, in U.S. Pat. Pub. No. 2013/0319404 to Feriani et al. and U.S. Pat. Pub. No. 2019/0014819 to Sur, the disclosure of each of which is incorporate herein by reference in its entirety.

In the depicted implementation, the outer tank wall 304 of the aerosol precursor consumable 300 is configured to be at least partially transparent or translucent so that the liquid composition 312 contained therein is visible externally. As such, in the depicted implementation the entire outer tank wall 304 is transparent or translucent. Alternatively, only a single side of the outer tank wall may be transparent, translucent, or tinted while the remaining portions of the outer tank wall may be substantially opaque.

The housing panel 400 is removable and replaceable and forms part of an outer surface of the control unit 200. In the depicted implementation, the housing panel 400 comprises a three-sided housing panel (see FIG. 3); however, in other implementations a housing panel may have any number of sides, including, but not limited to, a single-sided housing panel, a two-sided housing panel, a four-sided housing panel, etc. In some implementations, one of the sides of a housing panel may form the entire side of the control unit, or a partial side of the control unit.

Referring to FIG. 2, in some implementations, the housing panel may include an aperture (e.g., a cut-out, opening, or notch) to allow for viewing of the consumable when inserted into the control unit; however, in other implementations, the aperture may be expressly excluded. In the depicted implementation, the aerosol delivery device 100 is configured so that at least a portion of the reservoir 314 is visible through the outer tank wall 304 when the aerosol precursor consumable 300 is received in the control unit 200. In the depicted implementation, the housing panel 400 includes an aperture 402 through which the outer tank wall 304 and any liquid 312 that may be present in the reservoir 314 is visible when the aerosol precursor consumable 300 is engaged with the control unit 200. As illustrated, the aperture 402 is configured as a cut-out in the housing panel 400 such that when the housing panel 400 is received onto the control unit 200, the aperture 402 is positioned near the proximal end 208 of the control unit 200. In such a manner, the aperture 402 is positioned to provide visual access into the chamber 212 of the control unit 200. As illustrated, the cut-out is substantially oval-shaped; however, it is understood that any shape is encompassed herein. In some implementations, the aperture may be configured as a notch extending from the proximal end of the outer wall of the control unit some distance toward the distal end of the control unit. In other implementations, the aperture may be configured so as not to have any open borders and thus may expressly exclude a notch configuration as noted above. In some implementations, the aperture may be completely open or the aperture may have a transparent member (e.g., glass or plastic) positioned in the opening defined by the window or covering the window on one or both of the inner surface and outer surface of the outer wall of the device. In some implementations, the housing panel may include an output feature configured to allow an output signal of the control unit to pass therethrough. In the depicted implementation, for example, the housing panel 400 further includes a light window 404 that is configured to provide exterior viewing of a variable intensity light provided therethrough.

The housing panel 400 of the depicted implementation further defines a distal end 406 and a proximal end 408. Although other configurations are possible, in the depicted implementation, the aperture 402 is located approximately proximate the proximal end 408 of the housing panel 400 and the light window 404 is located proximate the distal end 406 of the housing panel 400. In some implementations, the housing panel 400 may include one or more input features configured to accommodate one or more user input elements located on the body frame 202 (such as, for example, one or more buttons) configured to receive an input signal from a user. For example, such input features of the housing panel 400 may comprise, in some implementations, one or more openings or apertures that provide access to the input elements on the body frame 202. In other implementations, such input features of the housing panel 400 may comprise one or more deflectable portions or buttons of the housing panel, such as, for example, one or more portions having a living hinge configured to depress input elements on the body frame 202.

In the depicted implementation, the housing panel 400 is configured to be releasably received onto the body frame 202 of the control unit 200. Although in other implementations a housing panel may be releasably received onto a body frame in a variety of different ways, the housing panel 400 of the depicted implementation is releasably received onto the body frame 202 via one or more rail features located on the housing panel 400 and/or the body frame 202. In particular, FIG. 3 illustrates a cross-sectional view of a portion of control unit 200. In various implementations, the housing panel and the control body may include complementary rail features configured to slidably engage with each other. In the depicted implementation, for example, the housing panel 400 includes a sliding rail feature 410, and the body frame 202 includes a receiving rail feature 230. It should be noted that in other implementations, the housing panel may include a receiving rail feature and the body frame may include a sliding rail feature. In the depicted implementation, the sliding rail feature 410 and the receiving rail feature 230 are complementary such that the sliding rail feature 410 is configured to fit inside and slide substantially longitudinally within the receiving rail feature 230.

With additional reference to FIG. 2, the housing panel 400 of the depicted implementation is configured to be inserted onto the body frame 202 by placing the proximal end 408 of the housing panel 400 proximate the distal end 206 of the body frame 202 (or the distal end 406 of housing panel 400 proximate the proximal end 208 of the body frame 202) and sliding the housing panel 400 via the rail features 410, 230 until the housing panel 400 reaches its installed position. Although in other implementations the installed position of the housing panel may be at any location with respect to the body frame, in the depicted implementation, the installed position of the housing panel 400 is such that the proximal end 408 of the housing panel 400 is located proximate the proximal end 208 of the body frame 202. In the depicted implementation, the sliding rail feature 410 comprises a lip or flange that extends inward from the housing panel 400, and the receiving rail feature 230 comprises a complementary groove or slot in the body frame 202 that is configured to slidingly receive the lip or flange of the housing panel 400. In the depicted implementation, the housing panel 400 and/or the body frame 202 further includes a detent feature (e.g., a protrusion and a corresponding depression) configured to temporarily (e.g., releasably) secure the housing panel 400 in its installed position. Other implementations may include additional or alternate features that temporarily secure the housing panel in its installed position, including, but not limited to, one or more magnetic securing features, one or more spring-loaded securing features, and/or a friction interface between the housing panel and the body frame. Still other implementations need not include a feature to temporarily secure the housing panel in its installed position.

Although the housing panel 400 of the depicted implementation engages with the body frame 202 via complementary rail features 410, 230, it should be noted that housing panels of other implementations may engage with body frames in other ways. For example, a housing panel of some implementations may engage with a body frame via one or more of an interference or friction fit. In other implementations, a housing panel and/or a body frame may include features configured such that the housing panel clips onto the body frame. In other implementations, a housing panel may engage with a body frame via a magnetic connection. For example, a housing panel and a body frame of some implementations may include one or more magnets. In other implementations, a housing panel or body portion may include one or more magnets and a portion of a housing panel and/or a portion of a body frame may be made of a material configured to be attracted by a magnet contained in a body frame or housing panel.

As noted, the housing panel 400 of the depicted implementation includes a light window 404 configured to substantially align with the light source 222 of the control unit 200. Although some implementations need not include a light window and other implementations need not include additional components, the housing panel 400 of the depicted implementation further includes a light tube 412 configured to transmit light emitting from the light source 222 of the control unit 200 through the housing panel 400. In some implementations, the housing panel may include a translucent or transparent portion, and/or may include an integrated lens located in a position that substantially aligns with the light source of the control unit. Other implementations may include other features configured to allow light from a light source to pass therethrough, including, for example, a series or pattern of microperforations that extend through the housing panel.

In the depicted implementation, the housing panel 400 also includes an opening at the distal end 406 thereof configured to be located proximate the external connection element 220 when installed on the body frame 202 such that the electrical connectors 220*a*, 220*b*, 220*c* extend through the opening. In some implementations, the housing panel may also include one or more functional components, such as, for example, an electrical connector 414, configured to electrically connect to the external connection element of the body frame when the housing panel is in its installed position. For example, the housing panel of some implementations may include a supplemental power source such as, for example, a supplemental battery, that electrically connects to the external connection element when the housing panel is in its installed position. In other implementations, the housing panel may include a charging device, such as, for example, a photoelectric cell configured to charge a rechargeable power source of the control unit. In other implementations, the housing panel may include one or more display elements, such as, for example, a digital display configured to convey information to a user. In other implementations, the housing panel may include one or more user input elements, such as, for example, one or more buttons configured to operate one or more functions of the device.

In various implementations, the housing panel of the present invention is readily removable and replaceable thus permitting customization of the aerosol delivery device. For example, the housing panel of various implementations may include a customizable feature that provides for customization of the control unit or aerosol delivery device. Such customizable features, may include, but need not be limited to, one or more of a surface color of the housing panel, a surface contour of the housing panel, a surface pattern of the housing panel, a surface texture of the housing panel, one or more surface projections of the housing panel, a profile of the housing panel, a material of the housing panel, or any combination thereof. In such a manner, the housing panel of some implementations may have a customizable feature (e.g. color, contour, pattern, texture, projections, profile, material, etc.) that is different than the other portions of the aerosol delivery device. In other implementations, the housing panel may have a customizable feature that is similar to other portions of the control unit or aerosol delivery device.

As noted, the aerosol delivery device 100 of the depicted implementation includes a control component 218 for controlling the amount of electric power to the heater during draw. Representative types of electronic components, structure and configuration thereof, features thereof, and general methods of operation thereof, are described in U.S. Pat. No. 4,735,217 to Gerth et al.; U.S. Pat. No. 4,947,874 to Brooks et al.; U.S. Pat. No. 5,372,148 to McCafferty et al.; U.S. Pat. No. 6,040,560 to Fleischhauer et al.; U.S. Pat. No. 7,040,314 to Nguyen et al. and U.S. Pat. No. 8,205,622 to Pan; U.S. Pat. Pub. Nos. 2009/0230117 to Fernando et al., 2014/0060554 to Collet et al., and 2014/0270727 to Ampolini et al.; and U.S. Pub. No. 2015/0257445 to Henry et al.; which are incorporated herein by reference.

In use, when an aerosol precursor consumable 300 is inserted into the receiving chamber 212 of the control unit 200, the fit may be such that air is capable of passing between the outer surface 304 of the aerosol precursor consumable 300 and the inner surface of the inner frame 212 of the control unit 200. Thus, when a user puffs on the mouthpiece portion of the aerosol precursor consumable 300 air may pass between the outer tank wall 304 of the aerosol precursor consumable 300 and the inner surface of the inner frame 214 and through an air entry 330 in the aerosol precursor consumable 300, mix with formed vapor near the atomizer 320, pass through the aerosol passage 316, and ultimately exit through an exit portal on the mouthpiece portion of the aerosol precursor consumable 300. The passage of air as defined above may be effective to cause pressure drop in the control unit 100 that can be sensed by the sensor through the aperture 215 in the receiving chamber 212.

As noted above, an input element may be included with the aerosol delivery device (and may replace or supplement an airflow or pressure sensor). The input may be included to allow a user to control functions of the device and/or for output of information to a user. Any component or combination of components may be utilized as an input for controlling the function of the control unit 100. For example, one or more pushbuttons may be used as described in U.S. Pub. No. 2015/0245658 to Worm et al., which is incorporated herein by reference. Likewise, a touchscreen may be used as described in U.S. Pub. No. 2016/0262454 to Sears et al., which is incorporated herein by reference. As a further example, components adapted for gesture recognition based on specified movements of the aerosol delivery device may be used as an input. See, for example, U.S. Pub. No. 2016/0158782 to Henry et al., which is incorporated herein by reference. In some embodiments, an input may comprise a computer or computing device, such as a smartphone or tablet. In particular, the aerosol delivery device may be wired to the computer or other device, such as via use of a USB (Universal Serial Bus) cord or similar protocol. The aerosol delivery device also may communicate with a computer or other device acting as an input via wireless communication. See, for example, the systems and methods for controlling a device via a read request as described in U.S. Pub. No. 2016/0007561 to Ampolini et al., the disclosure of which is incorporated herein by reference. In such embodiments, an APP (Application) or other computer program may be used in connection with a computer or other computing device to input control instructions to the aerosol delivery device, such control instructions including, for example, the ability to form an aerosol of specific composition by choosing the nicotine content and/or content of further flavors to be included, choosing the total particulate matter (TPM) provided per puff, choosing a specific heating profile to be implemented, choosing a modifiable resistance to drawn, and the like.

Further indicators (e.g., a haptic feedback component, an audio feedback component, or the like) can be included in addition to or as an alternative to the LED. Additional representative types of components that yield visual cues or indicators, such as light emitting diode (LED) components, and the configurations and uses thereof, are described in U.S. Pat. No. 5,154,192 to Sprinkel et al.; U.S. Pat. No. 8,499,766 to Newton and U.S. Pat. No. 8,539,959 to Scatterday; U.S. Pat. Pub. No. 2015/0020825 to Galloway et al.; and U.S. Pat. Pub. No. 2015/0216233 to Sears et al.; which are incorporated herein by reference. It is understood that not all of the illustrated elements are required. For example, an LED may be absent or may be replaced with a different indicator, such as a vibrating indicator.

In the implementation depicted in FIGS. 1 and 2, the aerosol precursor consumable 300 comprises a cartridge that includes a liquid composition configured to produce an aerosol via electrically generated heat. In other implementations, other types of aerosol precursor consumables are possible. For example, FIG. 4 illustrates an aerosol delivery device 500 that comprises a control unit 600, a removable aerosol precursor consumable 700, and a housing panel 800, which forms part of an outer surface of the control unit 600, according to another example implementation. In the depicted implementation, the control unit 600 includes a body frame 602 that defines a control unit outer wall 604, a control unit distal end 606 (which in the depicted implementation may comprise a mouthend of the control unit 600), and a control unit proximal end 608. In the depicted implementation, the control unit proximal end 608 includes an opening 610 that provides access to a receiving chamber 612. In the depicted implementation, the control unit 600 is configured to receive the aerosol precursor consumable 700 to provide a functioning aerosol delivery device 500. Although other implementations may differ, the control unit 600 of the depicted implementation is configured to receive substantially the entire length of the aerosol precursor consumable 700. In the depicted implementation, the receiving chamber 612 is defined by the control unit 600. In other implementations, however, the receiving chamber may be defined in part by the control unit and in part by the housing panel.

In the depicted implementation, the housing panel 800 is removable and replaceable and forms part of an outer surface of the control unit 600. Although in other implementations the housing panel may have any number of sides, the housing panel 800 of the depicted implementation is a three-sided housing panel. In the depicted implementation, the control unit 600 comprises a holder configured to receive an aerosol precursor consumable 700 that comprises a cartridge configured to produce an aerosol via an ignitable heat source (e.g., a carbon-based heat source). For example, in some implementations, the heat source may comprise a combustible fuel element that incorporates a combustible carbonaceous material. In other implementations, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. In other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG (Liquified Petroleum Gas) or LP (Liquified Petroleum)-gas), propane, propylene, butylenes, butane, isobutene, methyl propane, or n-butane. In still other embodiments, the heat source may comprise a chemical reaction based heat source, wherein ignition of the heat source comprises the interaction of two or more individual components. For example, a chemical reaction based heat source may comprise metallic agents and an activating solution, wherein the heat source is activated when the metallic agents and the activating solution come in contact. Some examples of chemical based heat sources can be found in U.S. Pat. No. 7,290,549 to Banerjee et al., which is incorporated herein by reference in its entirety. Combinations of heat sources are also possible.

In the depicted implementation, the aerosol precursor consumable 700 defines a heated end 702 and a distal end 704. The consumable 700 of the depicted implementation further includes a heat portion 706 comprising a heat source 708, a substrate portion 710 comprising a substrate material 712, and an outer housing 714 configured to circumscribe at least a portion of the heat source 708 and substrate material 712. It should be noted that although in the depicted implementation the consumable 700 has a substantially cuboidal overall shape, in various other implementations, the consumable or any of its components may have a different shape. For example, in some implementations the consumable (and/or any of its components) may have a substantially cylindrical shape. In other implementations, the consumable (and/or any of its components) may have other hand-held shapes. Some examples of consumable configurations that may be applicable to the present disclosure can be found in U.S. patent application Ser. No. 16/515,637, filed on Jul. 18, 2019, and titled Aerosol Delivery Device with Consumable Cartridge, which is incorporated herein by reference in its entirety.

In some implementations a barrier may exist between the heat source and the substrate material. In some implementations, such a barrier may comprise a disc that may include one or more apertures therethrough. In some implementations, the barrier may be constructed of a metal material (such as, for example, stainless steel, aluminum, brass, copper, silver, gold, and bronze), or a graphite material, or a ceramic material, or a plastic material, or any combinations thereof. In some implementations, a heat transfer component, which may or may not comprise a barrier, may exist between the heat source and the substrate material. Some examples of heat transfer components are described in U.S. Pat. App. Pub. No. 2019/0281891 to Hejazi et al., which is incorporated herein by reference in its entirety. In some implementations, a barrier and/or a heat transfer component may prevent or inhibit combustion gasses from being drawn through the substrate material (and/or from being drawn through air passageways through which aerosol is drawn).

Although in various implementations the heat source may have a variety of forms, the heat source 708 of the depicted implementation comprises an extruded monolithic carbonaceous material that has a generally cuboidal shape. Although in other implementations, the heat source may be constructed in a variety of ways, in the depicted implementation, the heat source 708 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

In the depicted implementation, the substrate portion 710 comprises a substrate material 712 having a single segment, although in other implementations the substrate portion may include one or more additional substrate material segments. For example, in some implementations, the aerosol delivery device may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 712 of the depicted implementation).

In the depicted implementation, ignition of the heat source 708 results in aerosolization of the aerosol precursor composition associated with the substrate material 712. In the depicted implementation, an aerosol passage is configured to receive the generated aerosol therethrough in response to a draw applied to the mouthend of the control unit 600 by a user. In the depicted implementation, the mouthend (proximate the distal end 606), or other portion of the control unit 600 may include a filter configured to receive the aerosol therethrough in response to the draw applied to the mouthend by a user. In various implementations, the filter may be provided, in some aspects, as a disc radially and/or longitudinally disposed proximate the end of the control unit opposite the receiving end. In this manner, upon a draw on the mouthend of the control unit 600, the filter may receive the aerosol flowing through control unit 600. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the control unit may include a filter that may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. Pat. App. Pub. No. 2019/0289909 to Hejazi; U.S. patent application Ser. No. 16/408,942, filed on May 10, 2019, and titled Flavor Article for an Aerosol Delivery Device; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the consumable 700 of the depicted implementation, the substrate material 712 comprises a plurality of tobacco beads together formed into a substantially cylindrical portion. In various implementations, however, the substrate material may comprise a variety of different compositions and combinations thereof, as explained in more detail below.

In various implementations, the substrate material may comprise a tobacco material, a non-tobacco material, or a combination thereof. In one implementation, for example, the substrate material may comprise a blend of flavorful and aromatic tobaccos in cut filler form. In another implementation, the substrate material may comprise a reconstituted tobacco material, such as described in U.S. Pat. No. 4,807,809 to Pryor et al.; U.S. Pat. No. 4,889,143 to Pryor et al. and U.S. Pat. No. 5,025,814 to Raker, the disclosures of which are incorporated herein by reference in their entirety. Additionally, a reconstituted tobacco material may include a reconstituted tobacco paper for the type of cigarettes described in Chemical and Biological Studies on New Cigarette Prototypes that Heat Instead of Burn Tobacco, R. J. Reynolds Tobacco Company Monograph (1988), the contents of which are incorporated herein by reference in its entirety. For example, a reconstituted tobacco material may include a sheet-like material containing tobacco and/or tobacco-related materials. As such, in some implementations, the substrate material may be formed from a wound roll of a reconstituted tobacco material. In another implementation, the substrate material may be formed from shreds, strips, and/or the like of a reconstituted tobacco material. In another implementation, the tobacco sheet may comprise overlapping layers (e.g., a gathered web), which may, or may not, include heat conducting constituents. Examples of substrate portions that include a series of overlapping layers (e.g., gathered webs) of an initial substrate sheet formed by the fibrous filler material, aerosol forming material, and plurality of heat conducting constituents are described in U.S. Pat. App. Pub. No. 2019/0261685 to Sebastian et al., which is incorporated herein by reference in its entirety.

In some implementations, the substrate material may include a plurality of microcapsules, beads, granules, and/or the like having a tobacco-related material. For example, a representative microcapsule may be generally spherical in shape, and may have an outer cover or shell that contains a liquid center region of a tobacco-derived extract and/or the like. In some implementations, one or more of the substrate materials may include a plurality of microcapsules each formed into a hollow cylindrical shape. In some implementations, one or more of the substrate materials may include a binder material configured to maintain the structural shape and/or integrity of the plurality of microcapsules formed into the hollow cylindrical shape.

Tobacco employed in one or more of the substrate materials may include, or may be derived from, tobaccos such as flue-cured tobacco, burley tobacco, Oriental tobacco, Maryland tobacco, dark tobacco, dark-fired tobacco and *Rustica* tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al.; U.S. Pat. No. 7,011,096 to Li et al.; U.S. Pat. No. 7,017,585 to Li et al.; U.S. Pat. No. 7,025,066 to Lawson et al.; U.S. Pat. App. Pub. No. 2004/

0255965 to Perfetti et al.; PCT Pub. No. WO 02/37990 to Bereman; and Bombick et al., Fund. Appl. Toxicol., 39, p. 11-17 (1997); the disclosures of which are incorporated herein by reference in their entireties.

In still other implementations of the present disclosure, the substrate material may include an extruded structure that includes, or is essentially comprised of a tobacco, a tobacco related material, glycerin, water, and/or a binder material, although certain formulations may exclude the binder material. In various implementations, suitable binder materials may include alginates, such as ammonium alginate, propylene glycol alginate, potassium alginate, and sodium alginate. Alginates, and particularly high viscosity alginates, may be employed in conjunction with controlled levels of free calcium ions. Other suitable binder materials include hydroxypropylcellulose such as Klucel H from Aqualon Co.; hydroxypropylmethylcellulose such as Methocel K4MS from The Dow Chemical Co.; hydroxyethylcellulose such as Natrosol 250 MRCS from Aqualon Co.; microcrystalline cellulose such as Avicel from FMC; methylcellulose such as Methocel A4M from The Dow Chemical Co.; and sodium carboxymethyl cellulose such as CMC 7HF and CMC 7H4F from Hercules Inc. Still other possible binder materials include starches (e.g., corn starch), guar gum, carrageenan, locust bean gum, pectins and xanthan gum. In some implementations, combinations or blends of two or more binder materials may be employed. Other examples of binder materials are described, for example, in U.S. Pat. No. 5,101,839 to Jakob et al.; and U.S. Pat. No. 4,924,887 to Raker et al., each of which is incorporated herein by reference in its entirety. In some implementations, the aerosol forming material may be provided as a portion of the binder material (e.g., propylene glycol alginate). In addition, in some implementations, the binder material may comprise nanocellulose derived from a tobacco or other biomass.

In some implementations, the substrate material may include an extruded material, as described in U.S. Pat. App. Pub. No. 2012/0042885 to Stone et al., which is incorporated herein by reference in its entirety. In yet another implementation, the substrate material may include an extruded structure and/or substrate formed from marumarized and/or non-marumarized tobacco. Marumarized tobacco is known, for example, from U.S. Pat. No. 5,105,831 to Banerjee, et al., which is incorporated by reference herein in its entirety. Marumarized tobacco includes about 20 to about 50 percent (by weight) tobacco blend in powder form, with glycerol (at about 20 to about 30 percent weight), calcium carbonate (generally at about 10 to about 60 percent by weight, often at about 40 to about 60 percent by weight), along with binder agents, as described herein, and/or flavoring agents. In various implementations, the extruded material may have one or more longitudinal openings.

In various implementations, the substrate material may take on a variety of conformations based upon the various amounts of materials utilized therein. For example, a sample substrate material may comprise up to approximately 98% by weight, up to approximately 95% by weight, or up to approximately 90% by weight of a tobacco and/or tobacco related material. A sample substrate material may also comprise up to approximately 25% by weight, approximately 20% by weight, or approximately 15% by weight water—particularly approximately 2% to approximately 25%, approximately 5% to approximately 20%, or approximately 7% to approximately 15% by weight water. Flavors and the like (which include, for example, medicaments, such as nicotine) may comprise up to approximately 10%, up to about 8%, or up to about 5% by weight of the aerosol delivery component.

Additionally, or alternatively, the substrate material may include an extruded structure and/or a substrate that includes or essentially is comprised of tobacco, glycerin, water, and/or binder material, and is further configured to substantially maintain its structure throughout the aerosol-generating process. That is, the substrate material may be configured to substantially maintain its shape (e.g., the substrate material does not continually deform under an applied shear stress) throughout the aerosol-generating process. Although such an example substrate material may include liquids and/or some moisture content, the substrate may remain substantially solid throughout the aerosol-generating process and may substantially maintain structural integrity throughout the aerosol-generating process. Example tobacco and/or tobacco related materials suitable for a substantially solid substrate material are described in U.S. Pat. App. Pub. No. 2015/0157052 to Ademe et al.; U.S. Pat. App. Pub. No. 2015/0335070 to Sears et al.; U.S. Pat. No. 6,204,287 to White; and U.S. Pat. No. 5,060,676 to Hearn et al., which are incorporated herein by reference in their entirety.

In some implementations, the amount of substrate material used within the smoking article may be such that the article exhibits acceptable sensory and organoleptic properties, and desirable performance characteristics. For example, in some implementations an aerosol precursor composition such as, for example, glycerin and/or propylene glycol, may be employed within the substrate material in order to provide for the generation of a visible mainstream aerosol that in many regards resembles the appearance of tobacco smoke. For example, the amount of aerosol precursor composition incorporated into the substrate material of the smoking article may be in the range of about 3.5 grams or less, about 3 grams or less, about 2.5 grams or less, about 2 grams or less, about 1.5 grams or less, about 1 gram or less, or about 0.5 gram or less.

According to another implementation, a smoking article according to the present disclosure may include a substrate material comprising a porous, inert material such as, for example, a ceramic material. For example, in some implementations ceramics of various shapes and geometries (e.g., beads, rods, tubes, etc.) may be used, which have various pore morphology. In addition, in some implementations non-tobacco materials, such as an aerosol precursor composition, may be loaded into the ceramics. In another implementation, the substrate material may include a porous, inert material that does not substantially react, chemically and/or physically, with a tobacco-related material such as, for example, a tobacco-derived extract. In addition, an extruded tobacco, such as those described above, may be porous. For example, in some implementations an extruded tobacco material may have an inert gas, such as, for example, nitrogen, that acts as a blowing agent during the extrusion process.

As noted above, in various implementations one or more of the substrate materials may include a tobacco, a tobacco component, and/or a tobacco-derived material that has been treated, manufactured, produced, and/or processed to incorporate an aerosol precursor composition (e.g., humectants such as, for example, propylene glycol, glycerin, and/or the like) and/or at least one flavoring agent, as well as a flame/burn retardant (e.g., diammonium phosphate and/or another salt) configured to help prevent ignition, pyrolysis, combustion, and/or scorching of the substrate material by the heat source. Various manners and methods for incorporating tobacco into smoking articles, and particularly smoking articles that are designed so as to not purposefully burn virtually all of the tobacco within those smoking articles are set forth in U.S. Pat. No. 4,947,874 to Brooks et al.; U.S. Pat. No. 7,647,932 to Cantrell et al.; U.S. Pat. No. 8,079,371 to Robinson et al.; U.S. Pat. No. 7,290,549 to Banerjee et al.; and U.S. Pat. App. Pub. No. 2007/0215167 to Crooks et al.; the disclosures of which are incorporated herein by reference in their entireties.

As noted, in some implementations, flame/burn retardant materials and other additives that may be included within one or more of the substrate materials and may include organo-phosphorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium borate, ethanolammonium borate, ammonium sulphamate, halogenated organic compounds, thiourea, and antimony oxides are suitable but are not preferred agents. In each aspect of flame-retardant, burn-retardant, and/or scorch-retardant materials used in the substrate material and/or other components (whether alone or in combination with each other and/or other materials), the desirable properties most preferably are provided without undesirable off-gassing or melting-type behavior.

According to other implementations of the present disclosure, the substrate material may also incorporate tobacco additives of the type that are traditionally used for the manufacture of tobacco products. Those additives may include the types of materials used to enhance the flavor and aroma of tobaccos used for the production of cigars, cigarettes, pipes, and the like. For example, those additives may include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred casing materials may include water, sugars and syrups (e.g., sucrose, glucose and high fructose corn syrup), humectants (e.g. glycerin or propylene glycol), and flavoring agents (e.g., cocoa and licorice). Those added components may also include top dressing materials (e.g., flavoring materials, such as menthol). See, for example, U.S. Pat. No. 4,449,541 to Mays et al., the disclosure of which is incorporated herein by reference in its entirety. Further materials that may be added include those disclosed in U.S. Pat. No. 4,830,028 to Lawson et al. and U.S. Pat. No. 8,186,360 to Marshall et al., the disclosures of which are incorporated herein by reference in their entireties.

In some implementations, the substrate material may comprise a liquid including an aerosol precursor composition and/or a gel including an aerosol precursor composition. Some examples of liquid compositions can be found in U.S. Pat. App. Pub. No. 2020/0113239 to Aller et al., which is incorporated herein by reference in its entirety.

As noted above, in various implementations, one or more of the substrate materials may have an aerosol precursor composition associated therewith. For example, in some implementations the aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, a substrate material may produce a visible aerosol upon the application of sufficient heat thereto (and cooling with air, if necessary), and the substrate material may produce an aerosol that is "smoke-like." In other aspects, the substrate material may produce an aerosol that is substantially non-visible but is recognized as present by other characteristics, such as flavor or texture. Thus, the nature of the produced aerosol may be variable depending upon the specific components of the aerosol delivery component. The substrate material may be chemically simple relative to the chemical nature of the smoke produced by burning tobacco.

In some implementations, the aerosol precursor composition may incorporate nicotine, which may be present in various concentrations. The source of nicotine may vary, and the nicotine incorporated in the aerosol precursor composition may derive from a single source or a combination of two or more sources. For example, in some implementations the aerosol precursor composition may include nicotine derived from tobacco. In other implementations, the aerosol precursor composition may include nicotine derived from other organic plant sources, such as, for example, non-tobacco plant sources including plants in the Solanaceae family. In other implementations, the aerosol precursor composition may include synthetic nicotine. In some implementations, nicotine incorporated in the aerosol precursor composition may be derived from non-tobacco plant sources, such as other members of the Solanaceae family. The aerosol precursor composition may additionally, or alternatively, include other active ingredients including, but not limited to, botanical ingredients (e.g., lavender, peppermint, chamomile, basil, rosemary, thyme, eucalyptus, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD)). It should be noted that the aerosol precursor composition may comprise any constituents, derivatives, or combinations of any of the above.

As noted herein, the aerosol precursor composition may comprise or be derived from one or more botanicals or constituents, derivatives, or extracts thereof. As used herein, the term "botanical" includes any material derived from plants including, but not limited to, extracts, leaves, bark, fibres, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: Mentha Arventis, Mentha c.v., Mentha niliaca, *Mentha piperita, Mentha piperita citrata* c.v., *Mentha piperita* c.v, *Mentha spicata crispa, Mentha cardifolia, Mentha longifolia, Mentha suaveolens variegata, Mentha pulegium, Mentha spicata* c.v. and *Mentha suaveolens.*

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. Reference is made to the above description regarding possible flavorants, flavoring agents, and/or other components, which will not be duplicated here.

In the depicted implementation, the housing panel 800 engages with the control unit body frame 602 via a snap-fit engagement, however in other implementations the housing panel may engage with the control unit body frame in a variety of different ways. As noted above, examples include, but are not limited to, sliding rail features located on one or both of the housing panel and the control unit body frame, an interference or friction fit created between the housing panel and the control unit body frame, features configured such that the housing panel clips on the control unit body frame, a magnetic connection between the housing panel and the control unit body frame, etc.

In the implementation depicted in FIG. 2, the receiving chamber 212 is defined entirely by the control unit 200. In other implementations, however, the housing panel may define a portion of the receiving chamber. FIG. 5 illustrates one example of such an implementation. In general, the depicted implementation includes an aerosol delivery device 900 that comprises a control unit 1000, a removable aerosol precursor consumable 1100, and a housing panel 1200, which forms part of an outer surface of the control unit 1000. The removable aerosol precursor consumable 1100 of the depicted implementation represents one example of an aerosol precursor consumable, however aerosol precursor consumables of other implementations may differ. In the depicted implementation, the control unit 1000 includes a body frame 1002 that defines a control unit outer wall 1004, a control unit distal end 1006, and a control unit proximal end 1008. In the depicted implementation, the control unit proximal end 1008 includes an opening 1010 that provides access to a receiving chamber 1012. In the depicted implementation, the control unit 1000 is configured to receive an aerosol precursor consumable 1100 to provide a functioning aerosol delivery device 900. In the depicted implementation, the housing panel 1200 is removable and replaceable and forms part of an outer surface of the control unit 1000. In the depicted implementation, the receiving chamber 1012 is defined in part by the control unit 1000 and in part by the housing panel 1200. In such a manner, when the housing panel 1200 of the depicted implementation is removed, a portion of the receiving chamber 1012 is exposed.

Although in other implementations the housing panel may have any number of sides, the housing panel 1200 of the depicted implementation is a three-sided housing panel. It should be noted that the control unit 1000 and/or the aerosol precursor consumable 1100 of the depicted implementation may include one or more features described above with respect to FIGS. 1 and 2, which will not be duplicated here.

In the depicted implementation, the housing panel 1200 engages with the control unit body frame 1002 via a snap-fit engagement, however in other implementations the housing panel may engage with the control unit body frame in a variety of different ways. As noted above, examples include, but are not limited to, sliding rail features located on one or both of the housing panel and the control unit body frame, an interference or friction fit created between the housing panel and the control unit body frame, features configured such that the housing panel clips on the control unit body frame, a magnetic connection between the housing panel and the control unit body frame, etc.

In one or more implementations, the present disclosure may be directed to kits that provide a variety of components as described herein. For example, a kit may comprise a control unit body frame with one or more housing panels. A kit may further comprise a control unit body frame with one or more housing panels and one or more aerosol precursor consumables. In some implementations, a kit may comprise a control unit (assembled, or a control unit body frame with one or more housing panels) with one or more aerosol precursor consumables. A kit may further comprise a control unit (assembled, or a control unit body frame with one or more housing panels) with one or more charging components. A kit may further comprise a control unit (assembled, or a control unit body frame with one or more housing panels) with one or more batteries. A kit may further comprise a control unit (assembled, or a control unit body frame with one or more housing panels) with one or more aerosol precursor consumables and one or more charging components and/or one or more batteries. In further implementations, a kit may comprise a plurality of housing panels. A kit may further comprise a plurality of aerosol precursor consumables. A kit may further comprise a plurality of housing panels and a plurality of aerosol precursor consumables. A kit may further comprise a plurality of aerosol precursor consumables and one or more batteries and/or one or more charging components. In the above implementations, the aerosol precursor consumables or the control units (assembled, or a control unit body frame with one or more housing panels) may be provided with an atomizer inclusive thereto. The inventive kits may further include a case (or other packaging, carrying, or storage component) that accommodates one or more of the further kit components. The case could be a reusable hard or soft container. Further, the case could be simply a box or other packaging structure.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A control unit for use in an aerosol delivery device configured to receive a removable and replaceable aerosol precursor consumable, the control unit comprising:

a body frame defining a first portion of a receiving chamber; and a removable and replaceable housing panel configured to be releasably received onto the body frame, wherein the housing panel forms part of an outer surface of the control unit, and wherein the housing panel forms a second portion of the receiving chamber, wherein the receiving chamber is configured to receive the aerosol precursor consumable, and wherein the housing panel covers only a portion of the received aerosol precursor consumable.

2. The control unit of claim 1, wherein the first portion of the receiving chamber is located proximate a proximal end of the body frame.

3. The control unit of claim 1, wherein the housing panel is a single-sided housing panel.

4. The control unit of claim 1, wherein the housing panel has two or more sides.

5. The control unit of claim 1, wherein aerosol precursor consumable includes a mouthpiece portion.

6. The control unit of claim 1, wherein the control unit is configured to use electrical energy to energize a material of the aerosol precursor consumable to form an inhalable substance.

7. The control unit of claim 1, wherein the housing panel forms a single outer surface of the control unit.

8. The control unit of claim 1, wherein the housing panel forms two or more outer surfaces of the control unit.

9. The control unit of claim 1, wherein the housing panel includes a rail feature, and wherein the body frame includes a complementary rail feature configured to slidably engage with the rail feature of the housing panel.

10. The control unit of claim 1, wherein the housing panel includes a customizable feature comprising one or more of a surface color of the housing panel, a surface contour of the housing panel, a surface pattern of the housing panel, a surface texture of the housing panel, one or more surface projections of the housing panel, a profile of the housing panel, a material of the housing panel, or any combination thereof.

11. The control unit of claim 1 further comprising an output element configured to provide a visually perceptible output signal, and wherein the housing panel includes an output feature configured to allow the output signal to pass therethrough.

12. The control unit of claim 11, wherein the output feature of the housing panel comprises one or more of an aperture that extends through the housing panel, a series of microperforations that extend through the housing panel, a light tube configured to transmit the output signal through the housing panel, or any combination thereof.

13. The control unit of claim 1 further comprising an input element configured to receive input from a user, and wherein the housing panel includes an input feature configured to allow the input to pass therethrough.

14. The control unit of claim 13, wherein the input element comprises a button, and wherein the input feature of the housing panel comprises an aperture that extends through the housing panel.

15. The control unit of claim 13, wherein the input element comprises a button, and wherein the input feature of the housing panel comprises a corresponding button of the housing panel.

16. The control unit of claim 1, wherein one or both of the body frame or the housing panel includes a securing feature configured to releasably secure the housing panel to the body frame.

17. The control unit of claim 16, wherein the securing feature comprises one or more of a magnetic securing feature, a detent securing feature, a spring-loaded securing feature, or any combination thereof.

18. The control unit of claim 16, wherein the securing feature comprises a friction interface between the housing panel and the body frame.

19. The control unit of claim 1, wherein the body frame includes an external connection element proximate a distal end of the body frame, wherein the housing panel includes an electrical connector proximate a distal end of the housing panel, and wherein the electrical connector of the housing panel is configured to couple with the external connection element of the body frame.

20. The control unit of claim 19, wherein the housing panel includes a supplemental power source configured to provide power to the control unit via the electrical connector and electrical connection element.

* * * * *